US012442616B2

(12) United States Patent
Vabnick

(10) Patent No.: US 12,442,616 B2
(45) Date of Patent: Oct. 14, 2025

(54) HALF PIPE DISRUPTER

(71) Applicant: Disablement Technologies and Consulting LLC, Fredericksburg, VA (US)

(72) Inventor: Ian B. Vabnick, Fredericksburg, VA (US)

(73) Assignee: Disablement Technologies and Consulting LLC, Fredericksburg, VA (US)

( * ) Notice: Subject to any disclaimer, the term of this patent is extended or adjusted under 35 U.S.C. 154(b) by 0 days.

(21) Appl. No.: 18/776,888

(22) Filed: Jul. 18, 2024

(65) Prior Publication Data

US 2025/0027743 A1 Jan. 23, 2025

Related U.S. Application Data

(60) Provisional application No. 63/601,008, filed on Nov. 20, 2023, provisional application No. 63/527,781, filed on Jul. 19, 2023.

(51) Int. Cl.

| | |
|---|---|
| ***F42B 1/028*** | (2006.01) |
| ***F41B 9/00*** | (2006.01) |
| ***F42B 1/032*** | (2006.01) |
| ***F42B 3/08*** | (2006.01) |

(52) U.S. Cl.

CPC ..... *F41B 9/0046* (2013.01); *F42B 1/028* (2013.01); *F42B 1/032* (2013.01); *F42B 3/08* (2013.01)

(58) Field of Classification Search

CPC .... F42B 1/00; F42B 1/02; F42B 1/028; F42B 1/032; F42B 3/08; F41B 9/0046

USPC ..... 86/50

See application file for complete search history.

(56) References Cited

U.S. PATENT DOCUMENTS

| | | | | |
|---|---|---|---|---|
| 4,126,092 | A * | 11/1978 | Cross | F42B 1/02 89/1.14 |
| 4,160,413 | A * | 7/1979 | Ridgeway | F42B 3/08 102/306 |
| 4,955,939 | A | 9/1990 | Petrousky et al. | |
| 6,269,725 | B1 | 8/2001 | Cherry | |
| 6,584,908 | B2 | 7/2003 | Alford | |
| 7,299,735 | B2 * | 11/2007 | Alford | F42B 33/062 89/1.13 |
| 8,091,479 | B1 | 1/2012 | Jakaboski et al. | |
| 8,677,902 | B1 | 3/2014 | Rock et al. | |
| 9,322,624 | B2 | 4/2016 | Alford et al. | |
| 9,470,499 | B2 | 10/2016 | Benson | |

(Continued)

*Primary Examiner* — James S Bergin

(74) *Attorney, Agent, or Firm* — Leydig, Voit & Mayer, Ltd.

(57) ABSTRACT

Provided herein are mass focusing shaped charges and related methods useful for disrupting targets in either underwater or on land. The mass focusing shaped charges comprise an explosives shell having an explosives shell surface, wherein at least a portion is curved and defines an inner volume configured to contain an inner volume of fluid or a metal liner. A distal body is comprising a SMART material is positioned between the inner volume of fluid and a to-be-disrupted target. A conformable layer of explosives conforms to at least a portion of a surface of the explosives shell, the conformable layer of explosives configured for explosive initiation by a detonator. Upon explosive initiation the inner volume of fluid or metal liner is forcefully ejected to form a fluid or metal jet in a direction through the distal body and toward the target.

20 Claims, 21 Drawing Sheets

(56) References Cited

U.S. PATENT DOCUMENTS

| | | | | |
|---|---|---|---|---|
| 10,451,378 | B2 | 10/2019 | Vabnick et al. | |
| 10,760,872 | B2 | 9/2020 | Vabnick | |
| 10,794,660 | B2 | 10/2020 | Vabnick | |
| 10,921,089 | B1 | 2/2021 | Vabnick et al. | |
| 11,187,487 | B1 | 11/2021 | Vabnick et al. | |
| 11,262,155 | B2 | 3/2022 | Vabnick | |
| 11,274,908 | B2 | 3/2022 | Vabnick | |
| 11,421,971 | B2 | 8/2022 | Vabnick | |
| 11,898,830 | B2 | 2/2024 | Vabnick | |
| 11,933,580 | B2 | 3/2024 | Vabnick et al. | |
| 2002/0096079 | A1* | 7/2002 | Alford | F41B 9/0046 102/475 |
| 2024/0068767 | A1 | 2/2024 | Vabnick et al. | |
| 2025/0146799 | A1* | 5/2025 | Vabnick | F42B 33/062 |

* cited by examiner

HALF PIPE DISRUPTER

CROSS-REFERENCE TO RELATED APPLICATIONS

This patent application claims benefit of and priority to U.S. Provisional Patent App. Nos. 63/527,781 filed Jul. 19, 2023 and 63/601,008 filed Nov. 20, 2023, each of which are incorporated by reference herein.

STATEMENT REGARDING FEDERALLY SPONSORED RESEARCH OR DEVELOPMENT

This invention was made at least in part with U.S. government support under 15F06721D0003094 awarded by the Federal Bureau of Investigation. The U.S. government has certain rights in the invention.

BACKGROUND

Provided herein are shaped charges, also referred to as a half-pipe disrupter (HPD). The HPD is a versatile scalable mass focusing high explosive shaped charge that can be used to disrupt improvised explosive devices (IEDs)/ordnance on land, buried beneath the land surface, or IEDs/ordnance below the waterline and submerged, including at depths greater than 100 feet. The HPD is configured to solve the gap of dynamically disrupting IEDs submerged in water. The HPD produces a focal linear fluid jet with a scalable cut length, which has a reduced risk of shock initiating an IED's explosives. The HPD can also be modified to increase penetration by defined depths without increasing impact pressures. The HPD is a disposable and low-cost solution for disrupting targets that are underwater or that are on the land.

One common scenario is a container or backpack, which may be lost or abandoned, washes up or gets entangled in any of the above referenced environments, structures, or watercraft. In the vast majority of incidents, the discovered items are determined not to be hazardous. If, however, the item is deemed suspicious or in the worst case is confirmed as an IED or bomb, a bomb squad or explosives ordnance disposal (EOD) team would respond. Most often, old ordnance, flares, or pipe bombs are discovered at the water bottom. The motives as to why pipe bombs are used in waters range from experimentation, explosives fishing, vandalism, terrorism, or murder. Preferably the object is towed and neutralized on land or far from critical infrastructure or people. At times, a bomb technician diver is needed in the water. In either case, there is a need in the art for a reliable disrupter that can be deployed to render safe the object that may be a bomb quickly in situ regardless of whether the bomb was towed on land or underwater. The HPDs provided herein address this need in the art.

A major challenge for responders to an IED response underwater is to analyze the item of concern and 1) determine if it is a bomb and 2) determine its structure and contents. For example, an underwater IED (UIED) may have sub compartments to control buoyancy, hold the explosives main charge, or to house fuzing system(s). Conventional methods of X-ray diagnostics cannot be performed underwater. Water currents, confined space, and water visibility are all limiting factors in analyzing the bomb's structures, weakness of design, and explosives/fuzing position. It is highly likely that a projectile fired from gun style disrupters/dearmers or high explosive shaped charges may hit the bomb's main charge or miss the fuzing system. Perforating a UIED to flood it may stabilize the bomb for movement but will not necessarily disrupt the fuzing system nor separate the firing train. Submerging power sources and conductors underwater for extended periods of time can degrade output; however, many tested power sources initiate electric matches hours to days later. To further understand the situation, initiation tests were conducted with the power source underwater with a water sealant applied to power sources to prevent degradation. Test results indicate that some fuzing systems immediately function when exposed to moisture or when immersed in water. Disrupters used in the field should address these issues. The experiments show that a disrupter must do more than flood an IED's container. Flooding may be ineffective at neutralizing a bomb's triggering mechanism, functionality, and may cause the fuze to function. A disrupter underwater must neutralize the fuzing and firing system of the IED.

Several issues arise from the limited diagnostics options underwater. The bomb's fuzing system can be missed by a projectile and there is a high probability of a disrupter projectile impacting a bomb's main charge. If the disrupter over pressurizes the IED container then it may burst. The IED's contents will escape the container. This result will make verification of a successful render safe difficult. Factoring in all the above issues and negative flooding effects, a high explosive mass focusing shaped charge should have the following characteristics for maritime operations: the jet should have the work function to disable the fuzing system, the jet height should cover the entire longest dimension of the bomb so as not to miss the fuzing system, the jet should be narrow in width so as to not over pressurize the bomb's interior and cause the container to burst, the jet should have a low risk of shock initiating the bomb's main charge, and the jet should not over penetrate the bomb which may be set against a structure such as a ship's hull. In addition, the disrupter's explosives should be minimized to prevent a large gas bubble that could cause a secondary blast effect known as bubble energy to damage a ship or structure.

There are several commercial and improvised shaped-charges that drive water and each have their strengths and weaknesses. A common method is to attach the explosives to a plastic former, which is either seated inside the fluid, sandwiched between fluid chambers, or is on the outside surface of the fluid container. Pressure fields are produced by shaping explosives into hemispherical, parabolic, linear (wedge or hemi-cylindrical), rod and conical charge geometries. When the explosives are initiated, shocks form inside the water column and reflect off of the free field surfaces. Various parameters such as angles and corners within the container of fluid or on the explosive former define the pressure-time history of the gases and shocks acting on the water. There are regions of high and low pressure that will differentially accelerate the water to form a jet. High pressure regions are due to a Mach-stem effect which are formed by collisions of shocks, usually along a central axis or plane. A slug or static volume of water is formed into the jetting projectile after the explosives initiation, and water behind the explosives traps the gases, and acts a tamp thus increasing the duration of pressure acting on the slug. Shocks can also reflect at the tamper boundaries and move back into the water, amplifying the pressure.

Water and other fluids can be driven explosively using shaped-charges to form liquid jets which move at relatively high velocity and can perform work on a target. Explosives are shaped and immersed in the water or placed on the outside of a water container. The explosives' detonation produces shock waves that move through the water. Typically, to create a jet, the charge is configured such that the shocks along a central axis or a bisecting plane converge and form a Mach stem. The pressure is higher in the center compared to the sides. A pressure gradient results in the water accelerating differentially as its position moves away from the center. The result is a jet that has a velocity profile with faster water at its front and the gradient is such that the water slows as one moves towards the explosive gas products. That velocity profile provides a number of challenges, including jet destabilization, gasification and atomization arising from shock waves in the fluid.

Accordingly, there is a need in the art for specially shaped-charges and multi-point initiation configurations that can further independently control one or more liquid jet parameters relevant for tailoring the shaped-charge to the specific application, such as controlling liquid jet tip velocity, jet cross-sectional shape, integrity, size and the like. This is important as different targets and operational conditions can be addressed with the shaped-charges provided herein so as to achieve desired outcomes in a safe and reliable manner, including for improvised explosive device disruption. The HPDs provided herein address this need.

The HPD provided herein is distinct compared to conventional high explosive shaped-charges that produce fluid jets. Conventional high explosive commercial and improvised shaped-charges that drive water will be described so that the reader can appreciate the differences with the instant shaped-charges, including HPD's. The simplest designs are for omnidirectional disrupters that use a rod or axially aligned central core of explosives that is hand-packed or pre-formed by an extrusion process. They drive water in a radially expanding fashion and the jet breaks up quickly due to hoop stress. In contrast, water jets can be focused using the common method of attaching sheet explosives to a plastic shelled former which is either seated inside the fluid, sandwiched between fluid chambers, or is placed on the outside surface of the fluid container. Pressure fields are produced by shaping sheet explosives into hemispherical, parabolic, linear (wedge or hemi-cylindrical), rod and conical charge geometries. When the explosives are initiated, shocks form inside the water volume and reflect from the free field surfaces. Various parameters such as angles and corners within the container of fluid or on the explosive former define the pressure-time history of the gases and shocks acting on the water. There are regions of high and low pressure that will differentially accelerate the water to form a jet. High pressure regions are due to the above mentioned Mach-stem effect which are formed by collisions of shocks, usually along a central axis or plane. The result is a focusing of the water mass and the jet travels a distance before breaking apart due to the stresses described above.

Omni-directional fluid driving high explosive disrupters are good at delivering high impulse to a target and drive water in all directions from the central axis. Generally, those tools have axial or translational symmetry. Omnidirectional tools produce low density jets that particulate into droplets. A commercially available disrupter that uses a similar approach to the Fast Loading Explosives Catenary Advanced Technology (FLExCAT) (U.S. patent application Ser. No. 18/338,170 filed Jun. 20, 2023) to maximize explosive density is the Blockshot™ (U.S. Pat. No. 9,470,499 titled "Explosive disruption container"). There is no hand-packing of the explosives and therefore maximizes the explosive density. The Blockshot™ has a single explosive core. The disrupter has a rectangular container with flat faces and an internal housing that holds approximately a ⅛ sectioned cuboidal piece of an M112 demolition block. Due to the large flat surface of the explosives relative to the container size, a planar shock is produced and thus provides some directionality to the water jet, but for the most part the water jet is omnidirectional. Other omnidirectional tools are the Cherry Engineering Inc.'s Mineral Water Bottle (MWB) charge, and the Alford Technologies' Bottler charge (U.S. Pat. No. 9,322,624). They use a hand-packed rod-shaped explosive charge at the center of a cylindrically shaped container. The MWB produces a radially expanding wall of water that exponentially thins with distance from the charge center and forms water droplets. The notable difference in the Bottler are three hemi-cylindrical indentations on the outer bottle surface. The majority of the MWB and Bottler container surfaces are convex in appearance from the perspective of one looking from the outside-inwardly. This convex geometry, however, results in release wave amplification and rapid loss of liquid water due to gasification.

Concavities or dimpling on the face of water charges have been shown to cause jetting. The container surface indentation creates a shock cavity effect and the fluid jets at the center of each concavity. Although this is not a primary function of the parabolic shape for the FLExCAT, it does contribute to jet formation. Concavities at container surfaces can cause linear jets if the containers have translational symmetry. The jetting is due to a reduced distance between the container surface and the explosive charge at the center of the concavity thus this liquid has higher pressures overall at the cavity apex. In addition, the pressure along the air-water boundary causes the liquid to move inward because the air is compressible, low density, and readily displaced.

Using plastic shaped sheets to create a surface to shape sheet explosives is a conventional method to mass focus water or HEET, including as described in U.S. Pat. No. 11,187,487. In the case of the Hydrajet™ (U.S. Pat. No. 6,269,725 (Cherry)), a tall pyramidal chevron-shaped wedge of sheet explosives with an apex angle of 90 degrees is placed inside a cylindrical shaped fluid-filled container. Cherry proposes an adjustable apex angle and a scalability in disrupter size. Another example of a linear charge is the mod series of disrupters (U.S. Pat. No. 6,584,908 (Alford)). In that case, rather than a wedge, it is an arc section of a curved shape. Alford et al. use two separate water chambers and sandwich sheet explosives between them. The jet profile is similar to the Hydrajet™. Those linear high explosive charges form blade shaped water jets. Based on flash x-ray and CTH modeling, a cross sectioning of the jet would have the profile that is approximately a narrow ellipse. Those tools show a good balance of impulse and penetration of small to medium-sized thin skinned IEDs.

Some water-based charges are more effective at perforating barriers such as liquid follow-through (LIFT) charges (U.S. Pat. No. 4,955,939). Conical LIFT charges may appear similar in shape to the CAT disrupter (U.S. Pat. No. 10,921,089), but have an air void in the location where the water slug would be present in the CAT disrupter. The CAT charge has a plastic shell to shape and layer sheet explosives. The shell has a parabolic base and truncated cone section nearest the rim. Conical disrupters and the CAT disrupter are axisymmetric and they form liquid jets that are circular in cross section. The explosives in the LIFT systems are cuboidal or cylindrical blocks placed at the rear of the disrupter and oriented so that a flat face is abutting the water. The detonator is positioned coaxially down the center of the charge. The explosive detonation wave shock couples at the water interface producing an approximate planar shock front that travels into the water surrounding the hollow cavity causing the water to collapse into the void and jet forward.

The thin plastic liner collapses on itself and flows at the leading edge of the jetting fluid. Another example of a conical LIFT charge is the Rocksmith Precision Closer™ (U.S. Pat. No. 8,677,902). The cone angles are approximately 45 to 60 degrees and the jets are moving at extremely high velocities, traveling in some cases in excess of Mach 10. A larger example of a conical LIFT is the Scalable Improvised Device Defeat (SIDD) disrupter which can hold five gallons or more of water.

An example of a linear LIFT charge is the Stingray™ (U.S. Pat. No. 8,091,479) and a similar collapsible charge (U.S. Pat. No. 9,429,408). The cuboidal explosive charge is placed at the back of the disrupter and has no fluid tamping. The water surrounds a 'U' shaped profiled cavity. The container lines the inside of the cavity and collapses to form a plastic slug that jets forward with some water following behind it. LIFT charges generally produce narrow fluid jets of low mass. They have high jet stretch rates and are good barrier penetrators but yield low bulk work on media and low impulse in experiments. As a result, they are relatively poor general disruption tools.

Linear shaped-charges typically have translational symmetry and will result in a perforation that is proportional to their length. Due to this translational symmetry, shaped-charges can be scaled along the symmetry line while keeping the other dimensions constant. This results in the same quantity of explosives per unit length and a jet that has no height limitations. Thus, a jet can cover the height of the entire bomb or target. Linear scaling of the disrupter length produces a small increase in jet velocity and an increase in target penetration, thus the disruption metrics for a linearly scaled charge to its original size is approximately the same. A disrupter can be translationally scaled up, for example, to cut a house door in two or scaled down to cover the height of a shoebox-sized bomb. The advantage is minimizing the weight of the fluid-filled charge because the weight growth is linear. A key advantage of a linear disrupter jet covering the entire height of a bomb is that the jet will have a higher probability of hitting fuzing components and destroy them because their position may be unknown. In contrast, axisymmetric charges cannot be translationally scaled to improve the perforation height, but instead radially scaled to increase the cross-sectional area of the jet resulting in a radius squared dependent increase on fluid mass. The axisymmetric charges produce long jets that greatly enhance penetration depth compared to linear charges. Thus, linear charges have to be placed closer to the target.

The HPD mass focusing shaped charges provided herein are linear shaped charges that can be conveniently scaled geometrically or translationally and that are readily "tuned" to the target, including a target environment that is underwater or on land, in a low-cost, safe and effective manner. The HPDs address the need in the art for a versatile disrupter platform that can be used underwater (e.g. creeks, rivers, ponds, lakes, seas, or oceans) or on dry land/above the water line (e.g. ship decks, docks, bridges, tunnels, roads, structure interiors, inside transportation modes), with the ability to tailor jet parameters depending on the target and environment.

BRIEF SUMMARY

The mass focusing shaped charges provided herein address the need in the art for further independent control of one or more liquid jet parameters depending on the application of interest, including target type and target environment, spanning from underwater to land-based applications, in an efficient and easy to use manner. A preferred mass focusing shaped charge is a HPD.

In an embodiment, the mass focusing charge is used to disrupt a target, and comprises an explosives shell having an explosives shell surface having an inside surface and an outside surface. The inside and outside surface are separated by the thickness of the explosives shell. The term explosives former is also used to functionally describe the aspect that the inside shell surface supports an explosives material. The explosives shell may have a sectioned profile that is at least partially curved. For example, an HPD has a curvature at least partially corresponding to a hemi-cylinder. There are one or more symmetry planes in the explosives shell to ensure formation of a stable jet. The explosives shell has an inner volume defined by the explosives shell inside surface configured to contain an inner volume of fluid and a distal opening. During use, it is preferred that there be a structural confinement at the distal opening that further defines the inner volume. Accordingly, a distal body is connected to the explosives shell distal opening to close the inner volume and contain the inner volume of fluid. Preferably, the distal body comprises a surface material attenuation of rarefaction technology ("SMART"), (including as provided in US Pub. No. 20240068767, which is specifically incorporated by reference herein) material that is positioned between the inner volume of fluid and the target. The HPD is unique in that it is a high explosive shaped charge that uses a SMART material in this manner. The explosives shell is immersed in a fluid body. Depending on the application of interest, the fluid body may correspond to or be different than the fluid in the explosives shell inner volume. A conformable layer of explosives conforms to at least a portion of a surface of the explosives shell, preferably the explosives shell inner surface. The conformable layer of explosives is configured for explosive initiation by a detonator, such that upon explosive initiation the inner volume of fluid is configured to implode and form a fluid jet that is forced in a direction through the distal body toward the target. The fluid jet is relatively narrow compared to other conventional disrupters and wedge-shaped. The fluid jet will perforate a target along a line that is proportional to the axial length of the HPD's explosives shell.

The fluid body may form the inner volume of fluid. For example, the ends of the explosives shell may remain open so that when the explosives shell is immersed in the fluid body, the fluid body floods the inner volume. Alternatively, the inner volume of fluid may be formed from a liquid that is different than the fluid body. In this embodiment, the inner volume may be completely sealed from the fluid body, so that upon immersion in the fluid body, the inner volume is not flooded by it.

The at least partially curved explosives shell section profile may be defined by a geometric equation, including an equation that is selected from the group consisting of: a semicircle; a parabola; two equal length lines that end at an intersecting apex; a line; and any combination thereof. For example, a portion of the surface may be linear and another portion a parabola. The section profile, therefore, corresponds to a 3-D shaped surface described as: a hemicylinder, a paraboloid, a wedge, a cone, and any combination thereof.

The SMART material may be selected from the group consisting of: rigid polyurethane, a vinyl closed cell foam, a polyvinylchloride foam, and a structural foam.

The inner volume of fluid may have a fluid volume corresponding to a closed surface formed between the explosives shell and the SMART material.

The SMART material may be formed into: a cuboid geometry; or a proximal surface with a profile corresponding to an arc, paraboloid, or a pyramidal geometry. In embodiments, the SMART material may be stand-alone and so correspond to the distal body, or may be contained within a distal body container, including a SMART box. The distal body container may have an injection fill hole for introducing the SMART material. For example, an expanding polyurethane foam may be injected through the fill hole and expand to take up the entire interior volume of the SMART box.

The explosives shell is preferably curved and has a bisecting symmetry plane.

The explosives shell may be formed of a material that is flexible to provide an adjustable curvature by changing the radius of curvature of the explosives shell.

The SMART material may comprise a plurality of SMART layers, including a distal-most layer that is a jet clipper and at least one layer that is not a jet clipper.

The mass focusing shaped charge may further comprise a coupler connected to an outer surface of the explosives shell to connect to another mass focusing shaped charge in an end-to-end configuration. In this manner, the shaped charge is readily scaled to match any target size. In other words, by use of the couplers to connect in series configuration any number of shaped charges, the fluid jet height is increased and matched to target height, where height is the linear dimension that is parallel to the longitudinal axis of the HPD explosive shell. This is important because undersized jets comparted to target increases risk that target will not be disabled, including by jet miss of a critical target component, such as a fuzing system.

The mass focusing shaped charge may further comprise a connector to connect the mass focusing shaped charge to a target. The connector type depends on target characteristics. Examples include one or more of: a magnet; an adhesive; a flexible tripod; a strap such as a ratchet strap that can traverse outer perimeter of the target and shaped charge to tightly hold the shaped charge to the target; and any combination thereof. These connectors reflect that in various embodiments it is preferred to minimize the amount of fluid body between the shaped charge and the target. Accordingly, the distal body and/or SMART material is preferably positioned in such a way that it occupies the space between the shaped charge on the target. Accordingly, the connector can be affixed to the distal surface of the shaped charge, such as a distal surface of the distal body or the distal surface of the SMART material. For SMART material that is provided within a container that is formed by the distal body, such as a SMART box, the connector may be affixed to distal surface of the distal body or SMART box. Of course, depending on the connector, there may be different points of connection that are not the distal surface. For example, a ratcheting strap that tightens to hold the shaped charge to the target may not even contact the shaped charge distal surface.

In other embodiments, particularly for dry land-based applications, the mass focusing shaped charge may further comprise a container having a container volume to contain the "rest" of the mass focusing shaped charge as well as the fluid body. In other words, the container holds the fluid body, and the shaped charge is at least partially or completely immersed in the fluid body held by the container, thereby surrounding the explosives shell. The container can have a seal to contain the fluid body in the container volume, wherein the seal is optionally a threadable lid or a snap-on lid. Alternatively, or in addition thereto, a container may be configured to contain the inner volume of fluid and container with inner volume of fluid configured to fit and occupy the explosives shell inner volume.

The mass focusing shaped charge may further comprise one or more buoyancy control plates connected to the explosives shell or distal body. For example, sleeves may be connected to an outer surface of the shaped charge for convenient loading/unloading of buoyancy plates depending on the target depth beneath the water surface.

The mass focusing shaped charge may further comprise a firing train comprising a single detonator operably connected to the conformable layer of explosives, wherein the firing train is configured to provide a single point or multipoint explosive initiation of the conformable layer of explosives comprising one or more sheet explosives strips.

The mass focusing shaped charge may be configured to have a single point of initiation in an initiation zone that is on a longitudinal axis at a curvature apex at one of the following locations: at a charge center of the sheet explosives strip; or adjacent to a boundary edge of the sheet explosives strip.

The mass focusing shaped charge may further comprise a tow line attachment connected to an outer surface of the explosives shell or the SMART material. The connection point is simply any accessible region to a user who may clip and unclip a tow line. Accordingly, outer surface is any accessible location that does not adversely impact fluid jet formation. Hence side surfaces away from the distal surface are preferred, including on the side of the distal body or SMART box.

The mass focusing shaped charge may further comprise a locking fastener connected to the explosives shell surface to reliably fasten the detonator and configured to provide strain relief for an electric leads or shock tube lead of the detonator.

The mass focusing shaped charge may further comprising a sealable container that is operably connected to the explosives shell, the sealable container having a surface shape that aligns with the conformable layer of explosives; wherein the sealable container is filled with the inner volume of fluid that is positioned in the explosives shell inner volume. In this manner, the sealable container may provide the distal body and distal body surface as well as containing the inner volume of fluid.

The explosives shell may be formed of a material comprising plastic, steel, copper, aluminum, or brass. For material subject to fragmentation hazard, the conformable layer of explosives preferably comprises: an outer explosives layer; and an inner explosives layer. In this manner, the inner and outer explosives layer together counteract the otherwise explosive ejection of the shell.

The mass focusing shaped charge may further comprise a SMART tamp that covers the outer explosives layer, wherein the SMART tamp is formed from a natural or synthetic rubber whose density is equal to or greater than that of water, including for example by a factor of 1, 1.5, 2 or 3, such as by a factor that is greater than 1 and less than or equal to 3, and any subranges thereof. The maximum density is preferably less than or equal to the density of steel.

The mass focusing shaped charge is configured to be geometrically and/or translationally scaled proportionally relative to a height, a depth along a jet trajectory, or a barrier thickness of the target for controllable adjustment of at least one of the following target disruption parameters: a target barrier perforation; a target depth of penetration; an impact pressure; or a jet velocity. One simple scaling system connects multiple shaped charges to each other, such as by a fastener or a coupler. Geometric scaling increases penetration and impulse by the scaling factor, but does not change the jet velocity and thus the impact pressure. The impact pressure is proportional to the square of the jet velocity. To expand on the scaling concept, the translational scaling can be such that the ratio of the adjustable height of the HPD to the fixed radius is 1, 2, 2.5, 3, 4 or 10 for example. Using geometric scaling, the height and radius are scaled equally such that the scaling factor is 1.5, 2, 2.5, 3, 4 or 10 for example.

The mass focusing shaped charge may have a dimension of the shaped charge that is fixed, but the amount of the conformable layer of explosives is selected to control at least one of the following target disruption parameters: target barrier perforation; target depth of penetration; jet stretch rate; impact pressure; and/or jet velocity. Increasing the explosives per unit area of the conformable layer, correspondingly increases the aforementioned target disruption parameters. In this manner, provided are methods of adjusting a target disruption parameter by adjusting the amount of explosives per unit area of the conformable layer.

The mass focusing shaped charge may be used on land, including by incorporating the shaped charge into a fluid-filled container. In this embodiment, the distal body may be formed from a portion of a container that surrounds and contains the explosives shell and fluid body. For example, an inner facing surface of the container may have a portion to which the explosives shell is supported. Opposed to the supported explosives shell may be the SMART material that is positioned on the outer facing surface of the container. In this aspect, the distal body is functionally the container portion that is the wall sandwiched between the explosives shell and the SMART material, in combination with the SMART material.

Also provided are more conventional mass focusing shaped charges that do not require a liquid and are particularly well-suited for reliable and robust transit across an air gap, penetration through Earth by a penetration depth, and corresponding target disruption for a target that is buried in Earth. For example, in this embodiment the mass focusing shaped charge may comprise an explosives shell having: an explosives shell surface having an inside surface and an outside surface; an explosives shell sectioned profile that is at least partially curved; one or more symmetry planes; an inner volume defined by the explosives shell inside surface; a metal liner supported by the explosives shell inside surface; a first SMART material supported by the explosives shell outside surface; a conformable layer of explosives that conforms to at least a portion of the inside surface of the explosives shell, the conformable layer of explosives configured for explosive initiation by a detonator; a metal liner (e.g., relatively thin, such as between 0.04" and 0.25", including between about 0.0625"-0.125") supported by the conformable layer of explosives and positioned so that the conformable layer of explosives is sandwiched between the metal liner and the explosives shell; a second SMART material supported by the metal liner, wherein the second SMART material occupies the inner volume of the explosives shell. With this configuration, upon explosive initiation (e.g., via a detonator) the metal liner is crushed and flows as a jet having a blade geometry toward the target.

A stand may be used to align the shaped charge with a target. The target may be on land. The target may be buried. The target may by partially buried. A stand may be used to properly align the shaped charge so as to generate a fluid jet the will disrupt the target. The fluid jet may traverse an air environment, such as traversing through air corresponding to the stand-off distance.

Also provided herein are methods of disrupting a target using any of the mass focusing shaped charges described herein. For example, the method may comprise the steps of: providing any of the mass focusing shaped charges described herein; aligning the mass focusing shaped charge with a target; and detonating the conformable layer of explosives to explosively drive a mass toward the target. For embodiments where the mass is a liquid, the mass corresponds to a liquid jet from the inner volume of fluid. For embodiments where the mass is a metal liner, to the target in a fluid jet; thereby disrupting the target.

Also provided are methods of making any of the mass focusing shaped charges described herein.

DETAILED DESCRIPTION

Figure 1:
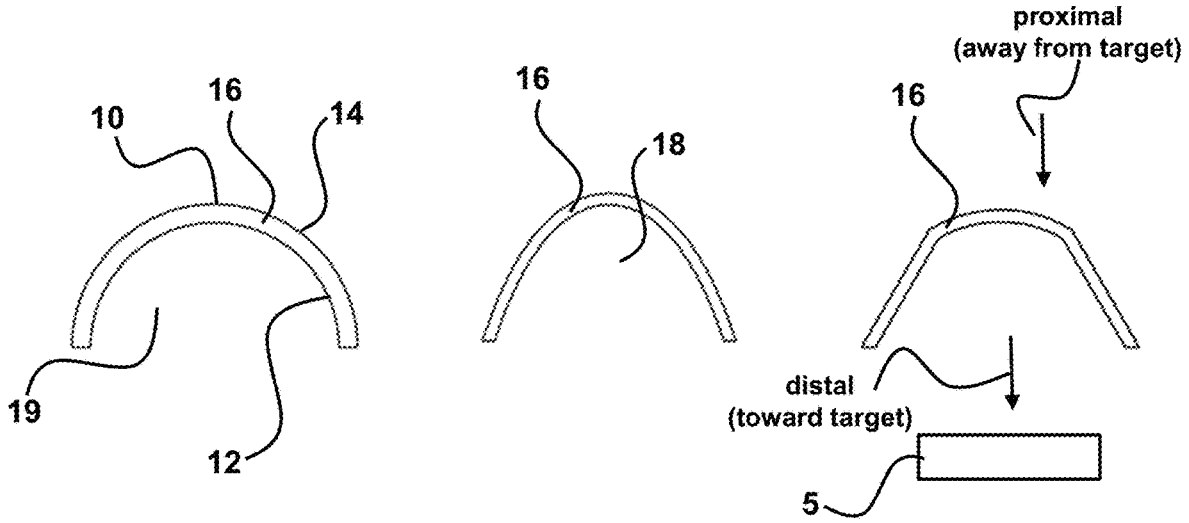
FIG. 1 illustrates explosives shell sectioned profiles of several embodiments. The profiles are curved and can be described generally as hemicylindrical, parabolic, and a complex geometry formed of a linear profile that transitions to a parabolic profile and then back to a linear profile.

The terms IED hazardous device, bomb, and ordnance are used interchangeably herein and are more generally referred herein as a "target".

"SMART" refers to a surface material attenuation of rarefaction shock waves material, including those materials described in US Pat. Pub. No. 2024/0068767, which is specifically incorporated by reference herein. In particular, a SMART material is an attenuating body configured to impact reflected shock waves that are otherwise propagated in the contained liquid and interact with liquid/wall interfaces. One example of a SMART material is a foam. "Foam" refers to a material that is formed by trapping pockets of gas in a liquid or a solid. A solid foam can be closed-cell or open-cell, depending on whether the pockets are completely surrounded by the solid material. In an open-cell foam, gas pockets connect to each other, including via pores. In a closed-cell, gas pockets are not connected to each other. The foam is polydisperse and is characterized as not uniform and stochastic. Foams efficiently attenuate shockwaves because of the heterogeneous structure in combination with low bulk density. In this manner, pressure waves are broken up and dispersed, thereby providing good shock tamping. Depending on the application of interest, which influences the desired liquid jet characteristics, the foam can be made from any of a range of materials, such as plastic, rubber (natural or synthetic), aluminum or other metals. For example, blasting cap protectors are made from aluminum foam because an aluminum foam absorbs the shock. The attenuating body may also be an aerogel. "Aerogel" refers to a synthetic porous material derived from a gel, where the liquid component has been replaced with a gas without significant collapse of the gel structure. Exemplary aerogels include, but are not limited to, solid smoke, solid air, solid cloud, blue smoke, silica aerogels, carbon aerogels, polymer-based aerogels, metal-oxide aerogels, and the like.

Bomb technicians and EOD technicians responding to an item suspected to be a bomb or confirmed IED may have to dive and conduct a render safe procedure below the water line. Water environments can be waterways such as seaways, harbors, ports, canals, or channels. Examples of freshwater or brackish environments are ponds, creeks, flooded quarries, and lakes. Larger bodies of water composed of saltwater are seas and oceans. Depths can range from near surface to 200 feet below. However, depths for bomb squad or EOD response are typically within 50 feet of the surface. A potentially hazardous object may be attached to or be positioned in close proximity to a pier, a bridge, a culvert, a boat or ship, or a submerged pipeline or power-line. Limpets and floating mines may have anti-disturbance, anti-intrusion, or anti-removal mechanisms that will trigger them to function. Mines can also have proximity sensing mechanisms such as metal detection, pressure wave, or contact action. Furthermore, IEDs that are in a water environment may also be time or command initiated.

The HPD gets its name from the embodiment that uses a hemicylindrical shaped shell for the explosives former. Construction is low cost because plumbing lines made from plastic PVC pipe, copper, brass, or steel pipe can be easily bisected forming two hemicylindrical surfaces. Any commercially available round-tube, plumbing pipes, and sewer pipes can be cut to form the hemicylindrical shape explosives shell (FIG. 1). An added benefit of these materials is their shock Hugoniot properties such as density and bulk speed of sound which makes them better tamping materials than water. Adding thickness to them enhances explosive tamping. For example, schedule 80 black pipe has a wall thickness of approximately 0.22" and for comparison, schedule 40 pipe has a wall thickness of approximately 0.15". The reason steel and other metals are not used in mass focusing charges is because they are a fragmentation hazard. The tamp can fragment and will be explosively accelerated to high velocities faster than most bullets. The HPDs provided herein solves this issue.

Figure 2:
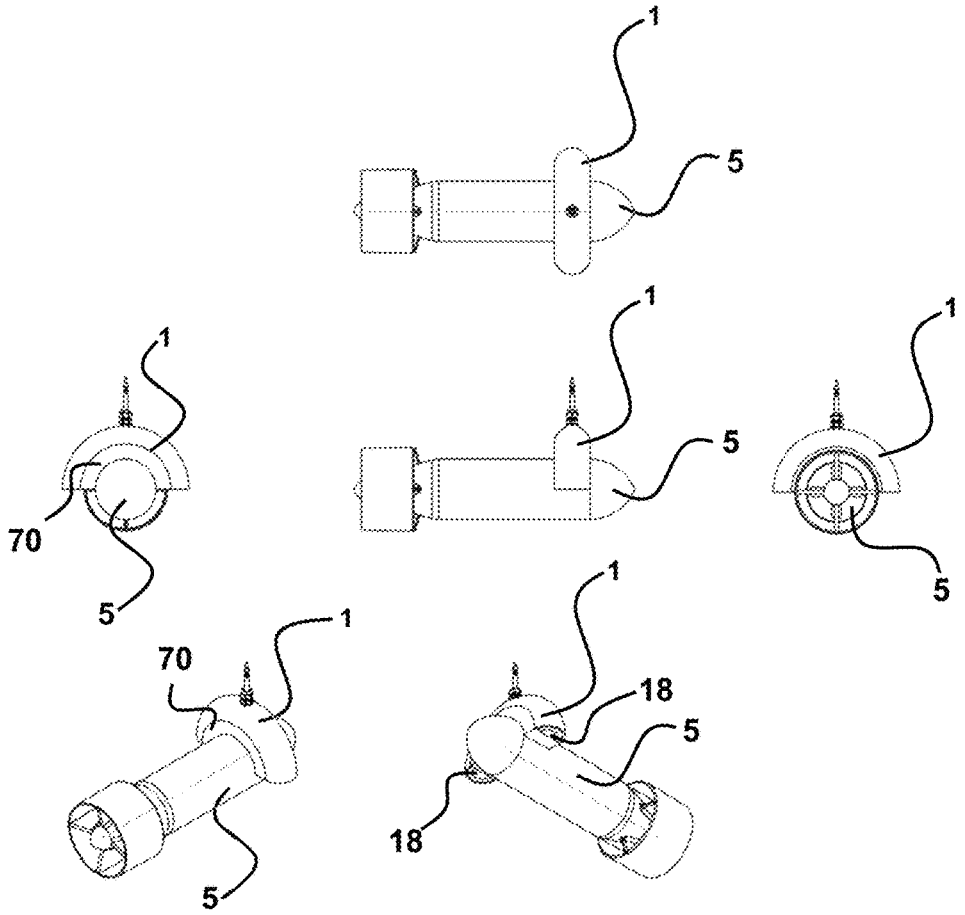
FIG. 2 illustrates an HPD that is immersed underwater. A curved HPD is oriented radially to a target that is a bomb in order to sever the fuze head from the main charge of a bomb. In this case, the bomb is underwater and the HPD inner volume is flooded by the fluid body. The water environment provides a semi-infinite tamp in the form of a fluid body that surrounds the HPD and the fluid body that can also reside in the explosives shell inner volume. In this embodiment, the "ends" of the inner volume may be open to the fluid body as the entire HPD is underwater.

Curved embodiments can be made from bent pipe fittings such as elbows with bends ranging from 22.5°, 45°, 60°, 90°, and 120°. Flexible piping such as those used in drainage systems provide a continuum of radial curvatures and corrugated piping will retain the curvature set by the user and can be adjusted in the field during an active operation. For IEDs and ordnance having curve profiled bomb casings or cylindrical sections, the bomb technician can use a flexible or rigid HPD to match the curvature. For example, FIG. 2, illustrates a mass focusing shaped charge 1 connected to a target 5, in various views, including perspective and end views. In this example, the shaped charge 1 is positioned to sever the fuze head from the main charge of target 5 that is a bomb underwater. The water environment ensures the inner volume 18 is flooded with water, and SMART material 70 is positioned between the inner volume 18 and target 5. The HPD is oriented such that the jet will section the bomb rather than cutting it lengthwise, separating the fuze head from the main charge. The advantages of using curved hemicylindrical or parabolic shapes are described below. Custom made curvatures can also be made using tubing and pipes, which are formable in a press or softened and bent. Drainage installers use a commercially available PVC heater/bender tool to adjust the curvature of drainage pipe on the job site. In a similar manner, the curvature of the explosives shell may be tailored to the corresponding curvature of the target or desired fluid jet parameters.

An explosives shell curved section profile is preferably a hemicylindrical shape because this shape is the most efficient geometry for mass focusing disruption. This is because a hemicylinder requires the minimum amount of sheet explosive for a given volume of material that is being explosively driven. The explosive gases shock and implode fillers such as water, semi-solids, fine granular material, or HEET fluids to form high velocity jets as based on the calculated ratio of volumes using different profiled explosives shells of the same area. A very common shape is a wedge/chevron shape that forms a triangular prism volume. Mathematically, the apex angle required to create the maximum volume is 90°. The closed volume defined by a hemicylindrical surface with the same surface area as the triangular prism is 1.27 times larger. This means that for a given amount of explosives the hemicylinder explosives will drive a jet with approximately 27% more mass. The other advantage of this hemicylindrical shape is the higher generated pressures due to the mach stem effect and the focusing of shocks to a center line that is equidistant radially. This line is in the bisecting plane and so a relatively narrow blade shaped jet forms.

The HPD is characterized as a linear shaped charge and can be scaled translationally, geometrically, or scaled by using a hybrid of the two scaling methods. Linear shaped charges form jets that are preferably the dimension of the charge in the symmetry axis direction. In addition, thickness/mass of sheet explosives are adjusted to modulate the jet tip velocity and jet stretch rate. Penetration is directly proportional to the length of the jet measured from jet tip to rear. Controlling penetration is important in a maritime environment. A beneath the surface (BTS) render safe procedure should effectively disrupt the bomb and cause minimal dispersal of components and controlled penetration depth to prevent significant damage to adjacent infrastructure or a boat/ship. It is impossible to confirm a bomb was neutralized if the explosives and fuze are lost underwater. The HPD is configured to minimize cavitation. Displacing large volumes of material inside the IED would cause it to violently rupture and expel its contents. In contrast, most other commercially available mass focusing disrupters cause considerable cavitation.

Figure 3:
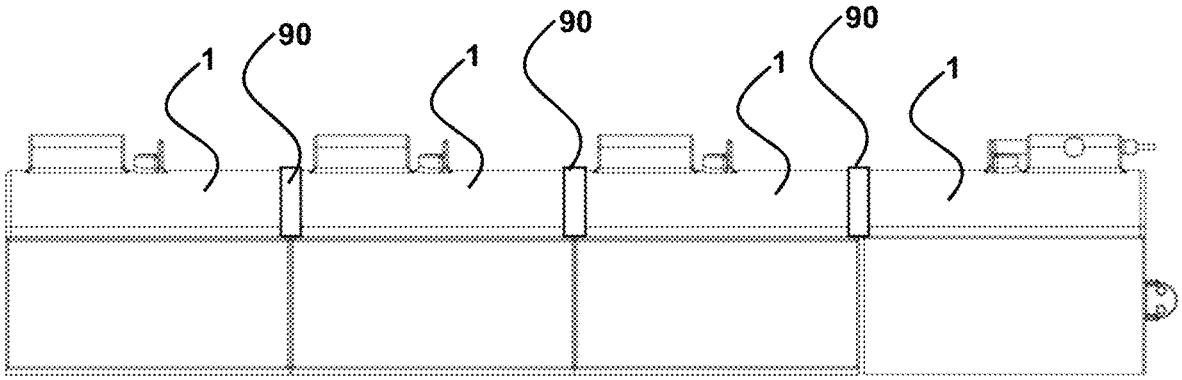
FIG. 3 illustrates four HPDs daisy chained together using connectors that couple adjacent HPDs to each other. The detonator in this example is capping into the right-most HPD. For a more uniform jet, multiple instant shock tube non-electric detonators can be capped into each of the HPDs and fired simultaneously in a multi-point configuration.

The HPD provided herein is configured so that the height dimension can be independently changed without changing the jet characteristics. If desired, the jet will perforate the IED from end-to-end. Another advantage of the instant HPDs are that they are scalable in height to whatever height is required. For example, a typical minimum height may be 4". The HPD can be readily configured to achieve, for example, an 11" in height, to cut a 50-caliber ammo can bomb completely along its long axis. Or, the HPD can be configured to generate a 35.5" in height jet to cut a 55 gallon drum skin completely along its long axis. A cut equal to the bomb's long axis dimension increases the probability that the jet disrupts the bomb's fuzing system and separates the firing train. By scaling the height of the tool without changing other parameters, the depth of penetration is fixed. HPDs can be cut to a specified height, or one embodiment is telescoping such that an HPD can be stretched from between 4" and 8", or 8" to 16", or any long axis dimension. Another simple solution to translationally extend the HPD to match a larger target is to use a coupler, such as connector 90 to lock two HPDs 1 together in an adjacent configuration (FIG. 3). FIG. 3 illustrates a connector 90 that snaps together. Other connectors may correspond to a sleeve that two sections slide inside and abut each other in a tight-fit configuration, an adhesive that bonds adjacent shaped charges 1 to each other, or notches/tabs on the end surfaces. In this manner, any number of shaped charges are connected to generate any of a range of jet heights tailored to the desired target disruption.

Alternatively, the cut height can be fixed and the depth of penetration adjusted. There are several ways this can be accomplished. One method is by geometrically scaling all dimensions but the height of the explosives shell. The benefit of this method is the velocity profile of the jet does not change and so the impact pressures remain the same. IEDs generally have impact sensitive explosives inside them and the impact pressures that shock the IED's main charge are proportional to the jet velocity squared. Geometric scaling also increases the barrier limit thickness, which means if a two-inch radius HPD disrupter can cut through 20-gauge steel and three-inch radius disrupter can cut through 18-gauge steel, and a four-inch radius disrupter can cut through 16-gauge steel without increasing the jet tip velocity. A second method to increase the barrier limit thickness is by increasing the sheet explosives mass/unit area or changing from a PETN-based sheet explosives to an RDX-based sheet explosives; the former has a 63% by weight explosives content and the latter has a 92% by weight explosives content. Furthermore, RDX has a higher specific energy than PETN.

Figure 4:
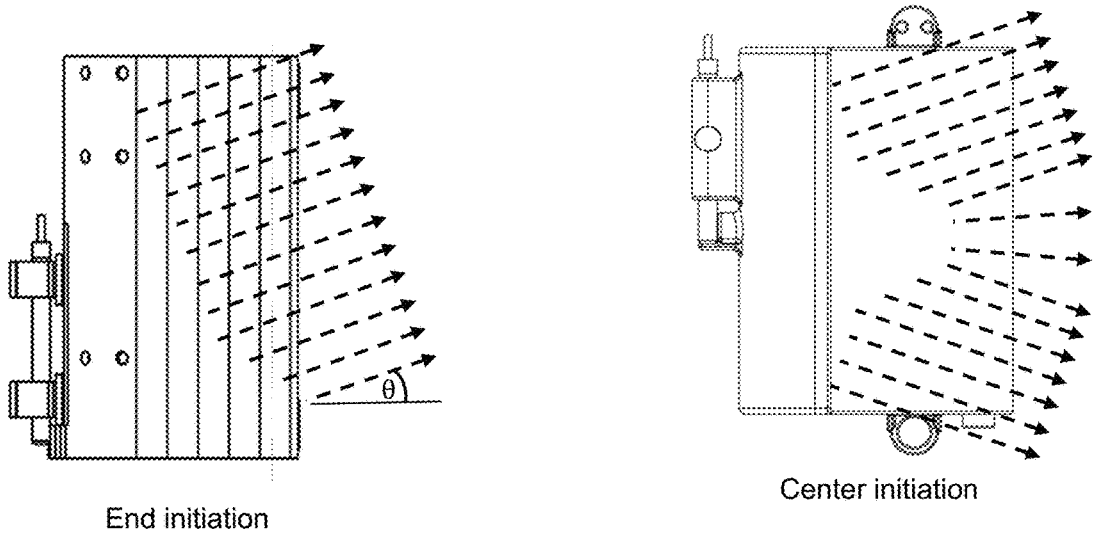
FIG. 4 illustrates end (left panel) and center (right panel) initiation with resultant explosive detonation and corresponding liquid jet particle vector lines. There is a distance before the reaction is steady state. As such, the detonation velocity and thus the shock velocity in the water is slower nearer the initiation point. The projection angle for particle velocity is known as the Taylor projection angle and is provided by θ. The dashed lines show the direction of particle velocity and the length is proportional to velocity.

Using a curved or bent HPD can focus shocks and pressure toward the center is another method to increase penetration. The result is a jet that focuses inward and, because the same mass of water is accelerated, the jet narrows in height but extends in length. Penetration is directly proportional to jet length. In addition to increasing penetration, there are other beneficial aspects of bent and curved HPDs. An issue with center priming an HPD is that the explosive pressure increases with distance from the center as the detonation wave moves towards both ends of the charge. There is a distance to run before the detonation reaches steady state. The detonation velocity grows. In addition, the pressure builds and self-confines behind the propagating wave thus increasing it. As described, using a SMART material at the distal end (e.g., "front") of the inner volume of fluid ("water slug"), reduces this effect and helps the water to bunch which results in a more uniform velocity in the linear jet tip. We observe in CTH hydrocode that without the use of a SMART material, the center of the linear jet has a slower velocity than the jet zone nearer the ends of the linear jet front. Similar to light waves, there is a refractive effect between the detonation wave and the shock wave in the fluid. The refractive behavior is similar to what is described in Snell's law which dictates light bending when passing from one media to the next. The shock wave will be at a relative angle to the detonation wave. The sine of the angle is equal to the ratio of the velocities. The fluid will move in the direction of the shock wave. The result is the water isn't pushed normal to the long axis of the charge, but will move at the angle. This angle is referred to as the Taylor projection angle (FIG. 4). The consequence for a straight HPD, or any linear mass focusing shaped charge for that matter, is the water jet height expands until the water is stretched apart because water cannot withstand tensor stress; the jet eventually atomizes. At a critical bend or curvature, the shock waves are parallel and the jet doesn't stretch at the top and bottom edge. In addition to controlling jet profile, a curved HPD is ideal to perforate a curved or cylindrical bomb geometry.

Figure 5:
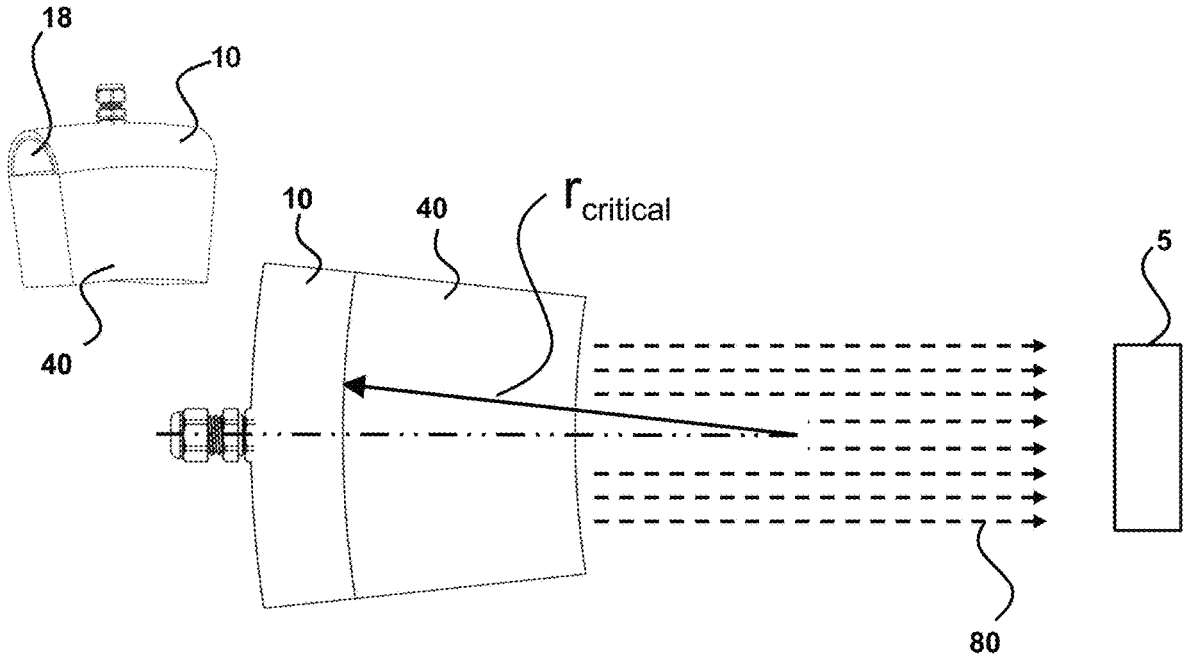
FIG. 5 illustrates that at a critical radius 'r', the curvature is such that the water will flow in one direction and toward the target.

At a critical curvature defined by the radius, the water within the jet travels all in the same direction toward a target (FIG. 5). Accordingly, one embodiment is an HPD having an explosives shell sectioned profile with a critical radius 'r', such that the liquid in the inner volume fluid flows in one direction and toward the target upon detonation.

Figure 6:
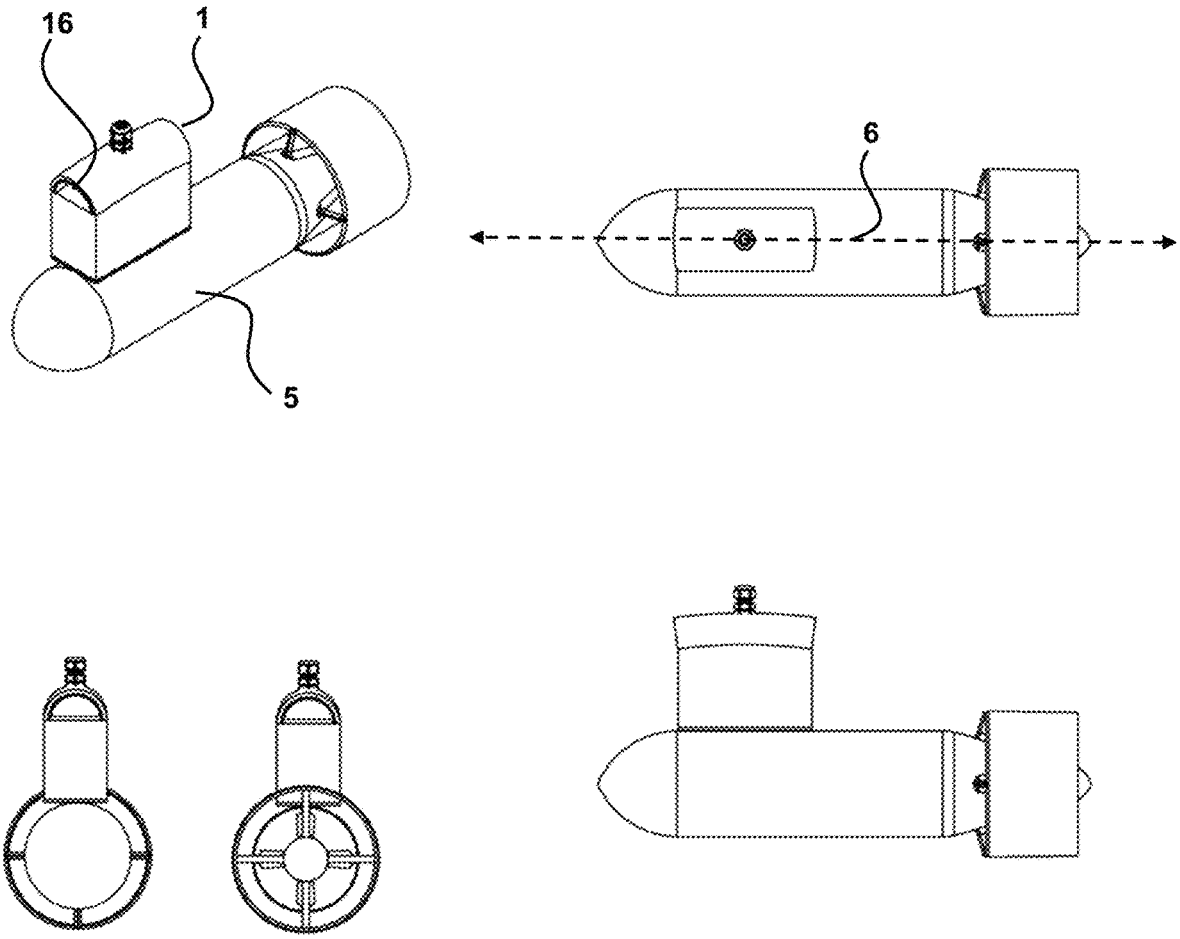
FIG. 6 is different views of a mass focusing shaped charge that is an HPD with a curvature defined by the critical radius and positioned to cut the bomb along a portion of the bomb's longitudinal axis. The optimum curvature results in greater penetration. In this example, the bomb is underwater, and the explosives shell inner volume is flooded with the water surrounding the HPD and target.

Penetration is optimum when the water jet has a uniform particle velocity from top to bottom and, therefore, an important embodiment for the mass focusing shaped charge is an explosives shell having a critical radius of curvature for the explosives shell curved section profile 16. So that the jet travels in one direction toward the target in a shape that is generally wedge-shaped. An example of a mass focusing shaped charge 1 with a critical radius to its curvature is provided in FIG. 6 for jet formation in a wedge shape aligned with the longitudinal axis 6 of the target.

Figure 7:
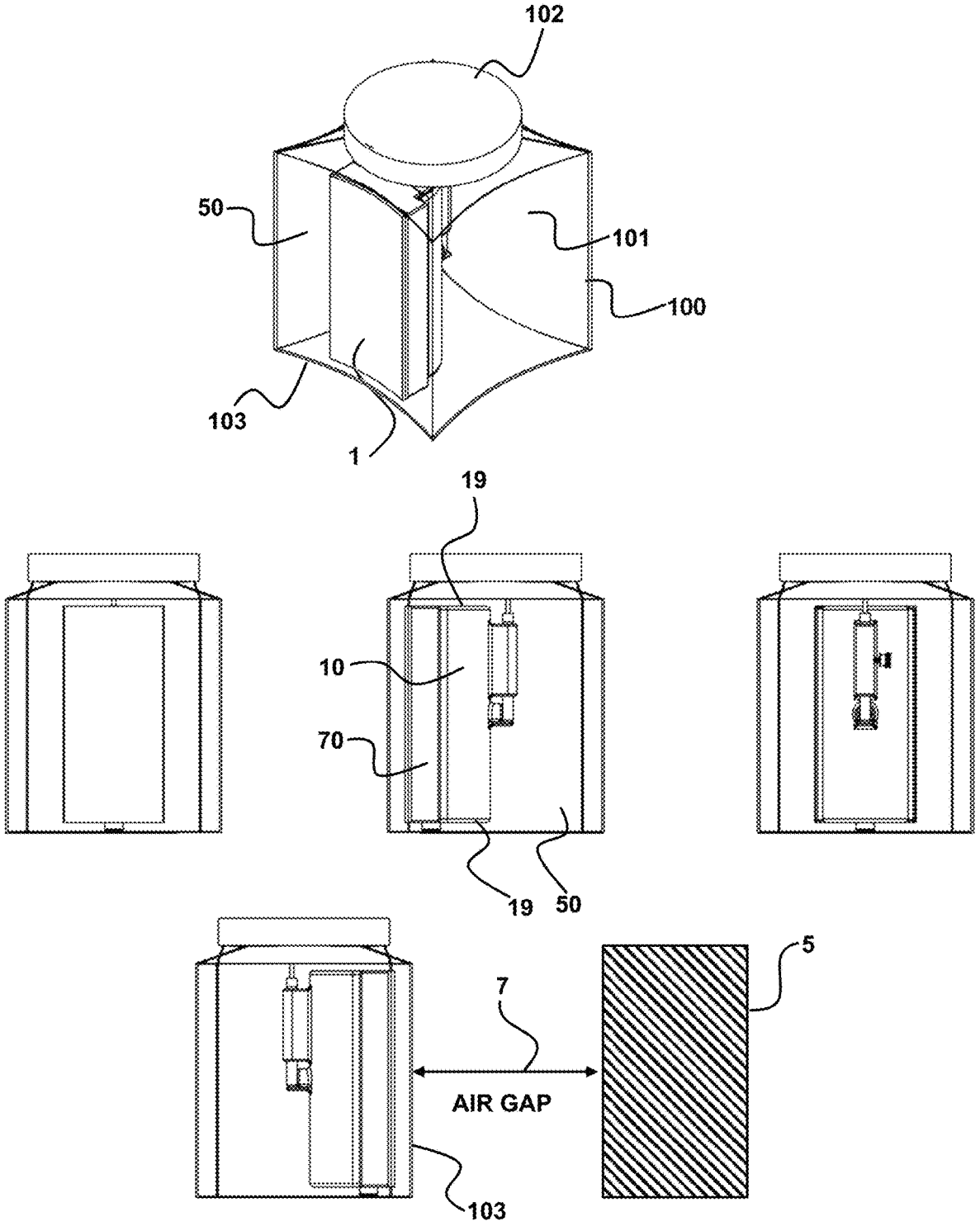
FIG. 7 illustrates the shaped charge in a configuration to disrupt a dry land-based target by inserting the HPD shaped charge into container filled with a fluid body, such as water. In this example, a FLEXCAT container is used.

One important aspect of the mass focusing shaped charge is that the inner volume of fluid and the tamp are both formed by the water in which the charge is placed. No container is needed for such underwater embodiments. For example, immersing the mass focusing shaped charge into a pond results in the pond water flooding the region adjacent to the explosive shell to form the inner volume of fluid. The surrounding pond water acts as a semi-infinite tamp. The mass focusing shaped charge 1 can be converted to a traditional dry land-based mass focusing disrupter by immersing the shaped charge inside of a sealable container 100 that holds a fluid (FIG. 7). Any container, including the FLExCAT disrupter can be used. The container 100 is filled with a fluid such as water. See also, as another embodiment, FIG. 14, where the inner volume fluid is contained within a container 100 that is sealed by a seal 102.

For land-based operations, when the mass focusing shaped charge is fired, the inner volume of fluid perforates the distal body and exits the shaped charge in the form of a fluid jet in the surrounding air environment. The fluid jet may travel an unconfined distance through air, corresponding to a set-off distance between the shaped charge and the target, and subsequently strike the target surface. In this aspect, target parameters and standoff distance are important aspects for successful IED disruption.

FIG. 7 illustrates container 100 and seal 102 (e.g., a removable lid) that form a container volume 101 that is configured to hold a fluid body 50 that surrounds the mass focusing shaped charge 1. The inner volume of fluid within the explosives shell 10 may be a liquid that is the same as fluid body 50 (particularly for embodiments where the top and bottom of the explosives shell are open to flood the inner volume 18 with fluid body 50) or may be different than fluid body 50, such as for embodiments where explosives shell 10 is sealed off from fluid body 50 by top and bottom shell surfaces 19. As previously described, SMART material 70 is positioned between the inner volume of fluid and the target. The container may have a surface shape 103 that is curved, including a curvature that matches the curvature of the explosives layer supported by the explosives shell surface, wherein the surface shape 103 is positioned between the shaped charge 1 and a target. For consistency, the container surface shape 103 is described as the container distal surface since it is the surface that is positioned closest to the target (see, e.g., FIG. 1 for distal (toward target) and proximal (away from target) definitions). For dry land application, there can be an air gap or standoff distance 7, between the container distal surface 103 and the target 5. The bottom graphic in FIG. 7 shows the standoff distance 7. Exemplary standoff distances 7 include between 0.25" (about 0.7 cm) to 72" (about 183 cm). The other container surfaces may be similarly curved thereby ensuring appropriate functionality irrespective of container orientation, or may be straight-lined or otherwise curved (meaning container is directionally biased so that user must take care to ensure the SMART material 70 is adjacent to the container surface shape 103.

For conventional mass-focusing disrupters used on land, the fluid jet forms in air before it hits a target IED. Examples of traditional linear mass focusing disrupters are the Hydrajet which uses a chevron shaped explosives shell, the Demimod which uses a curved section profile shaped explosives shell, and the axisymmetric disrupter known as the catenary advanced technology (CAT; see, e.g., U.S. Pat. No. 10,921,089) which uses a radially symmetric explosives shell that is a truncated cone capped with a catenoid. Those disrupters use specific containers to close the volume of water surrounding the explosives shell. In the case of the Demimod, the tamp water is in one sealed container and the water slug is in a second sealed container. The explosives are sandwiched between the two containers when they are mated. For the Hydrajet, the commercial container is approximately cuboidal and the chevron-shaped explosives shell's bisecting plane is collocated in the bisecting plane of the container. The container shape is critical for stable jet formation. The water-air interface affects jet stretch rate and gasification of the water volume. This is because of the rarefaction waves that reflect off the distal surface of the container. In contrast, due to the use of SMART material, the HPD is not dependent on specialized containers because the rarefaction waves are attenuated by the SMART material and jet bunching occurs at the SMART interface. When used on land, any container shape and size can be used. For example, a paint bucket, or a cuboid-shaped peanut jar, or an hour glassed shaped container with biaxial symmetry can be used. The orientation of the HPD symmetry plane relative to the container symmetry plane doesn't matter. However, some orientations are better than others. For example, an HPD positioned such that the SMART material is adjacent to the flat base of a bucket, is better than placing the HPD such that its longitudinal axis is parallel to the longitudinal axis of the bucket.

Figure 8:
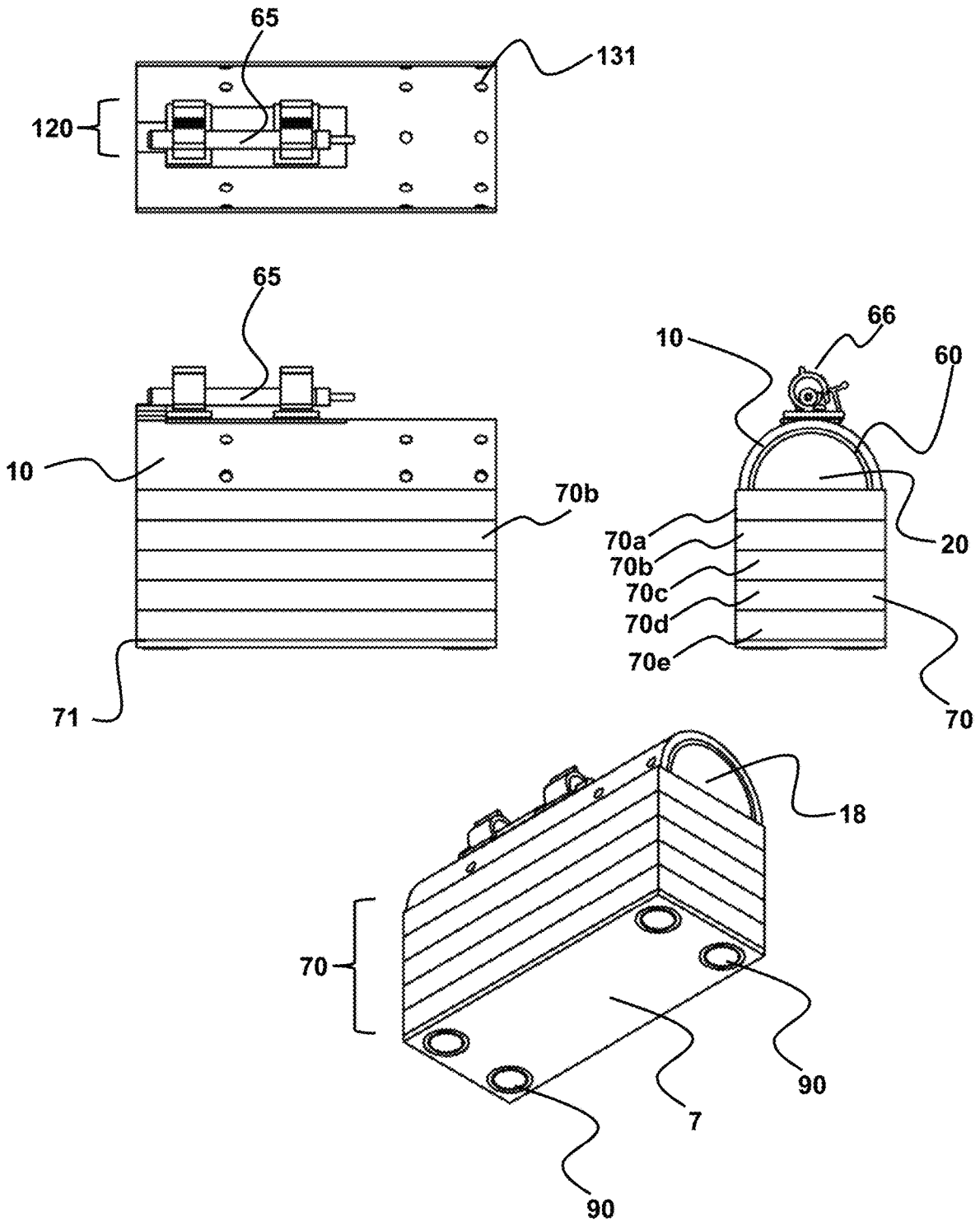
FIG. 8 illustrates the mass focusing shaped charge with a plurality of layers of SMART material. A strip of high-density rubber acts as a jet clipper to reduce shocks when the jet impacts the bomb. In this example, only the left most priming channel is filled with explosives. A booster of layered sheet explosives is adjacent to the blasting cap.

A jet will not form effectively by immersing any of the conventional referenced disrupters underwater. The ideal penetration equation predicts that a water-filled disrupter penetration through the open water medium is equal to jet length. If the jet is four inches in length, then it will erode away within four inches. Conventional disrupters are typically positioned with a standoff that is the width or diameter of the charge. A disrupter that is four inches wide would be placed four inches from the target. The jet will be exhausted before it reaches the target. Another consideration is the shock effects that are important in jet formation. In conventional disrupters, there is a water-air boundary at the fluid container wall. The shock wave generated by the explosive detonation reflects off the front face of the disrupter. The reflected wave is a rarefaction wave, which contributes to the velocity gradient within the water mass that adversely impacts the fluid jet characteristics. There is no rarefaction wave if the disrupter is immersed in a water environment. The water mass will pile up on itself and be projected mostly as unit mass rather than jet. The expansion and contraction of the explosive gas bubble would be the primary cause of target damage. To solve the issue of jet erosion in water and to produce the rarefaction wave, the mass focusing shaped charges provided herein can use SMART material(s) 70 to displace the water between the shaped charge distal surface and the target (FIG. 8). Above a critical shock pressure, the rarefaction wave will cause the water volume to vaporize into a gas bubble ruining the jet. The SMART material reduces the peak pressure of the reflected rarefaction wave.

FIG. 8 illustrates that the SMART material 70 may be formed from a plurality of SMART layers. In this example, there are five SMART layers (70*a*-70*e*). A jet clipper layer 71 may also be formed from a SMART material, such as rubber, that is different from the other SMART layers. Priming channels 131 can be filled with explosives and may be generally considered, alongside detonator 65, as part of the firing train 120 by which a well-controlled explosive initiation of conformable layer of explosives 60 occurs. This results in the inner volume of fluid 20 positioned in the shell inner volume 18 that is propelled toward a target. To facilitate connecting to a target surface, the mass focusing shaped charge may have connectors 90 on the distal surface, including a clipper layer 71, to reliably contact the shaped charge to the target. For a magnetizable target surface, the connectors may comprise magnets. Other connectors include adhesives, clips, straps, ratchet straps, and elastic bands positioned around the target and shaped charge outer surfaces. Ratcheting clip 66 may be used to secure the detonator 65 in place.

Examples of SMART materials include, for example, a closed cell rigid foam such as Fiberglast™ or a polyurethane foam. The optimal foam density is approximately 3 lb/ft$^3$. As noted above, the SMART material is beneficial because it attenuates the intensity of the rarefaction wave. Structural foams that have high compressive strength are necessary because at depth, the water pressure will cause foam to shrink. Experiments using Styrofoam showed that the foam shrank to half its volume at 33 feet (1 Atm) under water. Styrofoam is not characterized as a SMART material because it has no shock benefits. Furthermore, as noted above, it cannot retain its shape and shrinks when submerged making it impractical for underwater operations.

Figure 9:
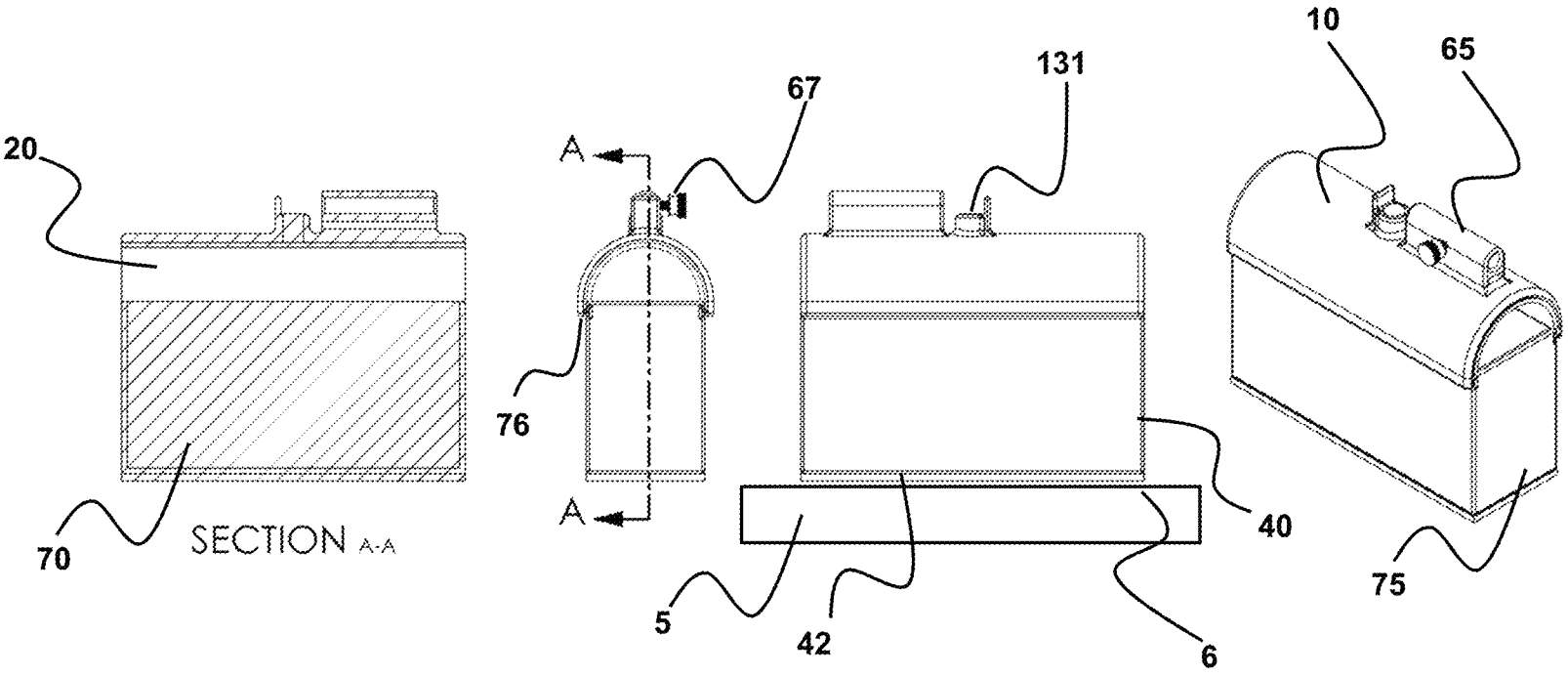
FIG. 9 is an embodiment having a SMART material of closed cell foam filling a plastic box (SMART box) which has coupling grooves to receive tabs on the explosives shell. The explosives shell is slid into position over the SMART box. A set screw locks the detonator after it is inserted through the tube. The end of the detonator is pressed against the priming channel booster of explosives that passes through the explosives shell and connects to the main charge (conformable layer of explosives).

Referring to FIG. 9 (third panel), it is undesirable for water to be positioned between the mass focusing shaped charge SMART 70 and the target 5. Ideally there is intimate contact between the distal surface 42 of the distal body 40 (e.g., SMART material) and the bomb container wall 6. If the target has a steel skin, magnets can be inserted into the bottom of the HPD to facilitate attachment. A tripod attachment can also be used using a ¼-20 threaded hole in the HPD. Flexible tripods can be wrapped around anchors such as piers or pilons. There are special adhesives that work under water and coating the bottom of the HPD will foster adhesion to the targeted device. To modulate shock pressures when the jet impacts the IED, the SMART thickness can be adjusted. In FIG. 8, a SMART material that is layered by a defined thickness for a specific amount of sheet explosives and HPD size. A denser SMART material can be used at the base of the HPD to clip the jet prior to impacting the bomb. This jet clipper can be made from synthetic and natural rubbers such as silicone and gum rubber. Eroding the jet tip before impact slows it down and causes jet bunching. The impact pressures drop significantly thereby reducing risk of unwanted shock initiation of the target.

In this example, the mass focusing shaped charge is end initiated. The explosive shell can have ports or channels, referred here as priming channels 131 (see, e.g., FIG. 8), cut into them which allows for initiation at many points at one time and at different locations on the conformable layer of explosives 60. At the desired initiation points, the priming channels are filled with explosives to allow the detonation from the blasting cap to propagate to the main charge of sheet explosives on the opposite side of the explosive shell.

Figure 10:
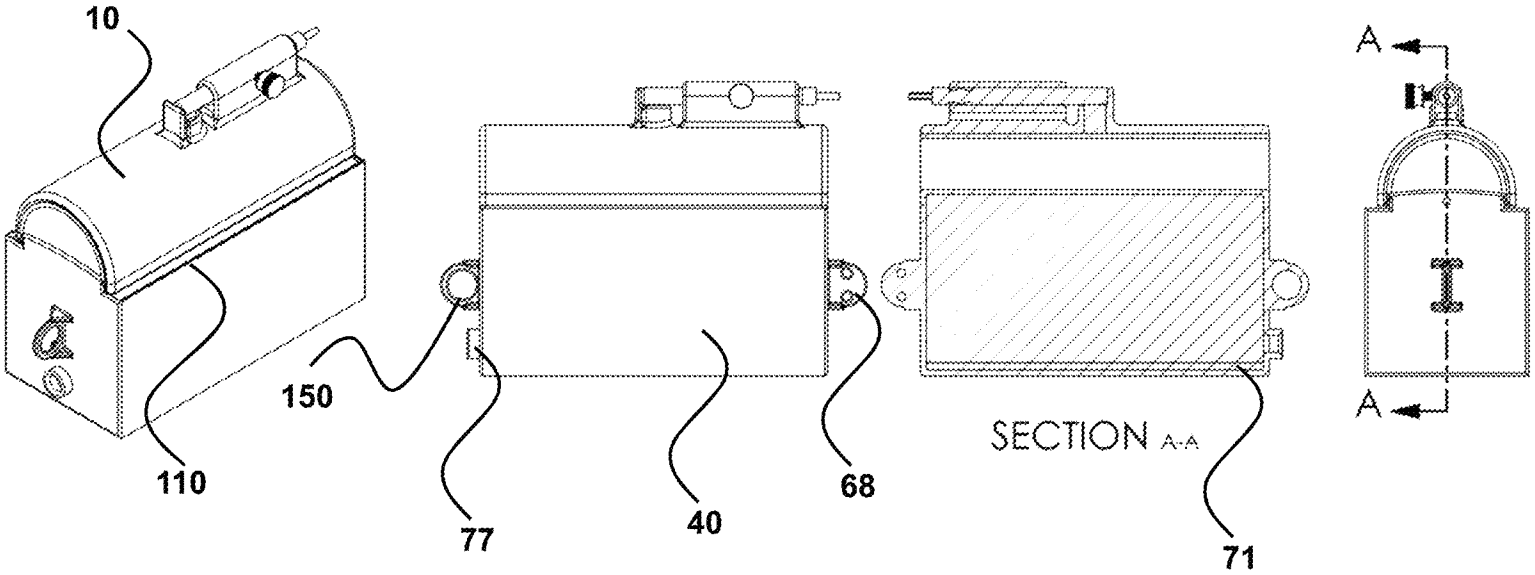
FIG. 10 is a mass focusing shaped charge that is specially configured for use with divers. For example, buoyancy control plates are connected to the shaped charge, such as inserted into pockets, to make the shaped charge neutrally buoyant. A tow line attachment point and detonator lead strain relief anchor prevent the detonator from pulling free while the diver is in transit to the target. The wire leads or shock tube lead can be lased through the two small holes. The lead is attached to a main line that extends above the water so the HPD can be fired on land or from a boat. In this example, the SMART surface facing the inner volume of fluid has a parabolic curvature to reduce the effects of the rarefaction waves, aid in jet formation, and increase the jet tip velocity.

A variety of detonator attachment methods can be used. In FIG. 8, ratcheting clips 66 lock the detonator 65 (that is within the detonator tube) into position. FIG. 9 shows another embodiment that uses a detonator tube and a set screw 67 to lock the detonator in place. In both examples, the detonator is side priming the priming channel explosives and a sweeping detonation wave initiates the priming channel booster. Reliable initiation of sheet explosives can be accomplished using the side priming method. A SMART box 75 may contain the SMART material 70. Accordingly, distal body 40 may correspond to the SMART material 70 for embodiments without a SMART box (see, e.g., FIG. 8) or may be a container 75 holding the SMART material (also referred herein as a "SMART box"). The explosives shell 10 may slide into position over a distal body 40 having a distal body surface 42. Distal body may also be referred to as a SMART box 75. In this manner, the distal surface 42 may be in intimate contact with a target surface 6, thereby avoiding unwanted gaps between the shaped charge and the target, including a water-filled gap. To facilitate introducing a SMART material into a distal body 42, including a SMART fill box 75, an injection fill hole 77 may traverse from the outer to the inner surfaces of the distal body (FIG. 10).

A diver who is carrying a shaped charge 1 such as a HPD underwater may have to deal with water currents, and poor visibility. FIG. 10 illustrates a tow line attachment 150 attached to the shaped charge surface. The line can then be clipped onto the diver thereby securing the shaped charge to the diver. As the diver transits the water to the target, the detonator leads are being pulled on. To prevent the detonator from slipping out from excessive tension on the lead(s), a detonator lead strain relieve anchor 68 is on the opposite side from the tow line attachment 150 point. The detonator leads are connected to a main firing line or shock tube trunk line that is fed out from the firing point on land or in a boat. The bulk of the SMART material is a closed cell foam and that will cause the HPD to rapidly float to the surface. To make the shaped charge neutrally buoyant, buoyancy control plates 110, including formed of steel, lead, brass, copper, or other heavy metal plating, may be inserted into pockets on both sides of the SMART box. If the operator temporarily loses control of the HPD just after disconnecting the tow line, it will float neutrally so it can be recovered. The explosives forming shell 10 in FIGS. 9 and 10 are attached to the SMART box that has grooves near the top. Tabs on the explosives former slide into these grooves and lock the former into place. For practical loading of the sheet explosives, the explosives former is attached to the SMART box after explosives are attached to it.

Figure 11:
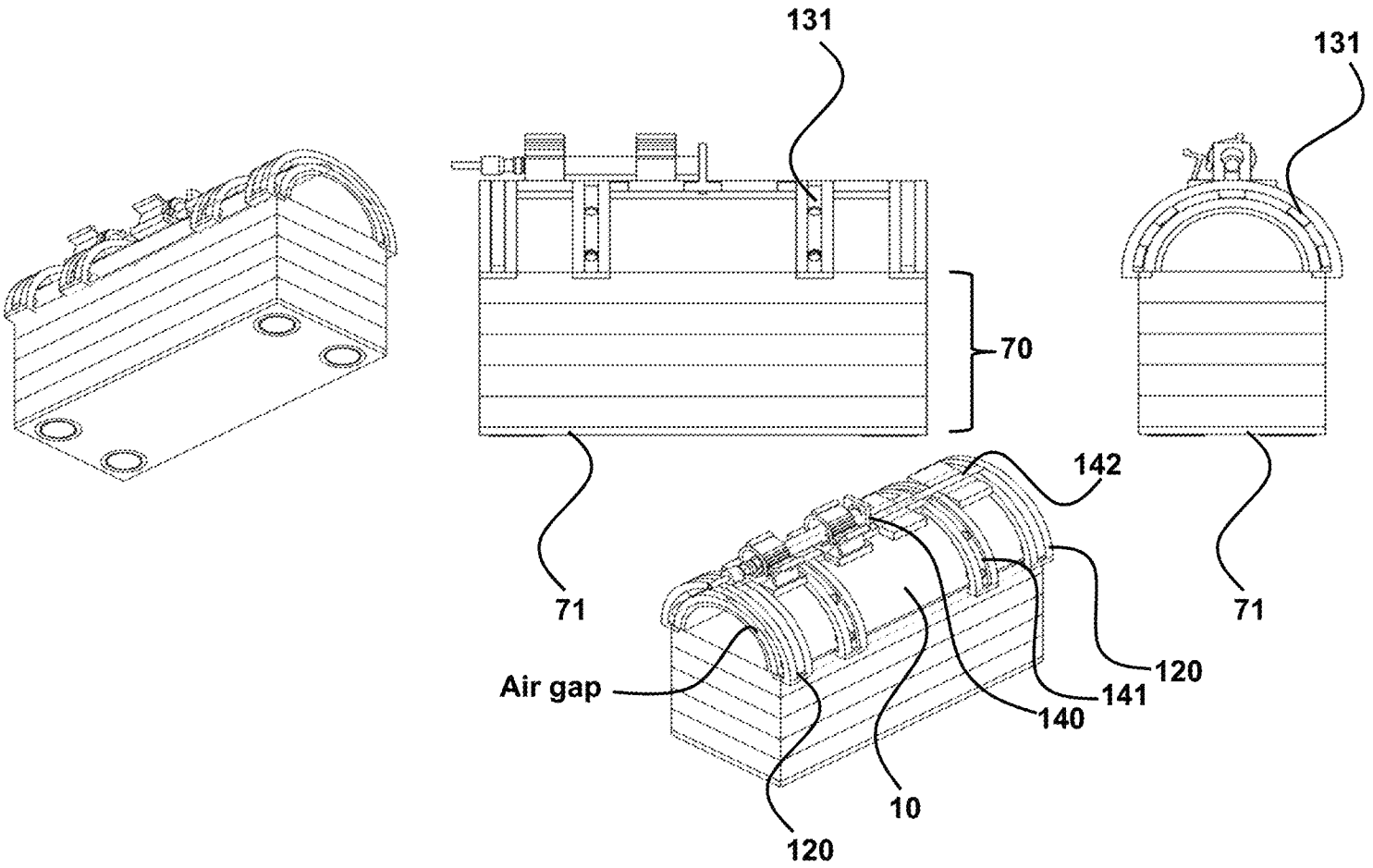
FIG. 11 illustrates a firing train guide that saddles the explosives shell with priming channels that are filled with strips of sheet explosives to propagate a detonation wave in both directions from the base of the detonator at the center of the shaped charge. The explosive strip may run along the apex and branches at both ends. Four of the priming channels are filled with explosives to simultaneously initiate at four points symmetrically positioned on the explosive surface, for example, simultaneously initiate the main sheet explosive charge near its four corners.

Multipoint initiation along the HPD apex or at four or more points on the sheet explosives can cause detonation waves to collide. Furthermore, multipoint initiation is a way to approximate instantaneous initiation of the explosives. The result is a more uniform and stable jet having a higher jet tip velocity. In FIG. 11, a firing train guide saddles the explosives former. Sheet explosive strips (142) are placed in the firing train guide grooves 141. One explosive strip 142 is at the apex and oriented longitudinally. In this example, additional strips branch off at the far ends of the HPD and four of the priming channels are filled with explosives. The initiation at the detonator placed in the center of the HPD causes detonation waves to propagate towards both ends. The detonation wave then turns the corner at the branches and travels to the priming channels that are filled with explosives. The detonation is communicated through the channel and the main charge is initiated near its four corners. The detonation waves formed expand from each point and collide causing higher shock pressures in the collision zones. Overall, the explosives are more uniformly initiated. The jet has a higher velocity and is more stable. In FIG. 11, there is a gap between the firing training guide and the explosives former which prevents shock coupling and undesirable premature initiation.

Figure 12A:
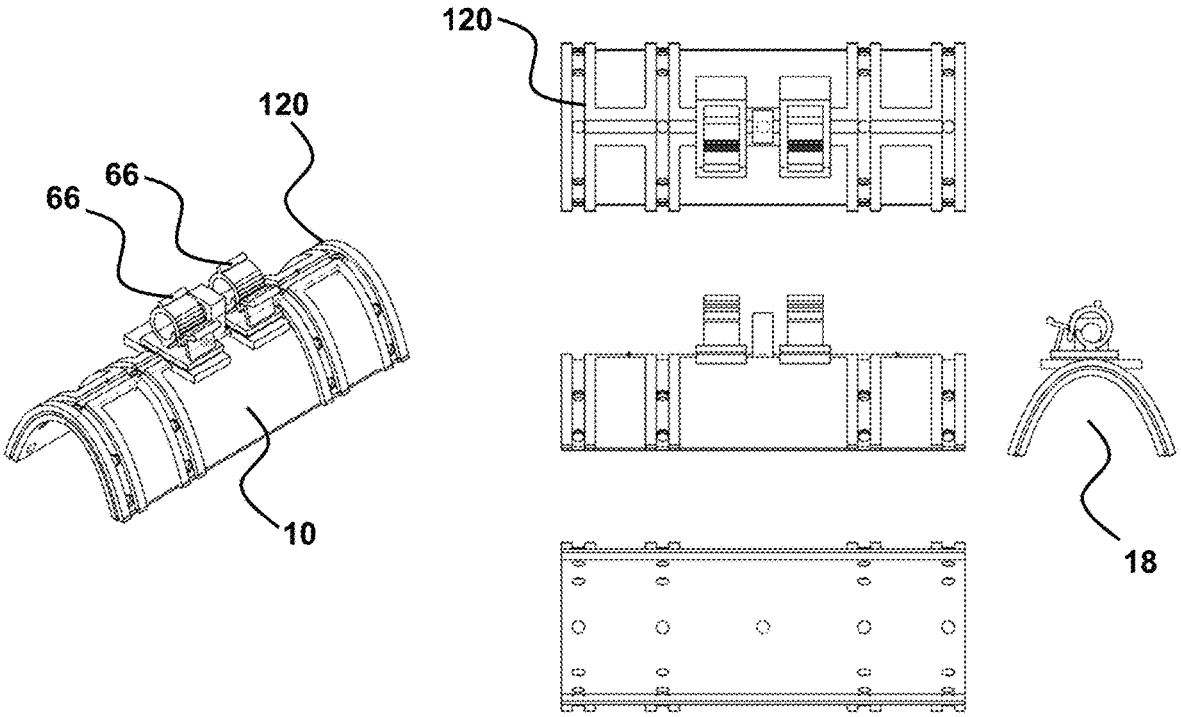
FIG. 12A contains various views of a parabolic explosives shell having an explosives firing train guide straddling the explosive shell.
Figure 12B:
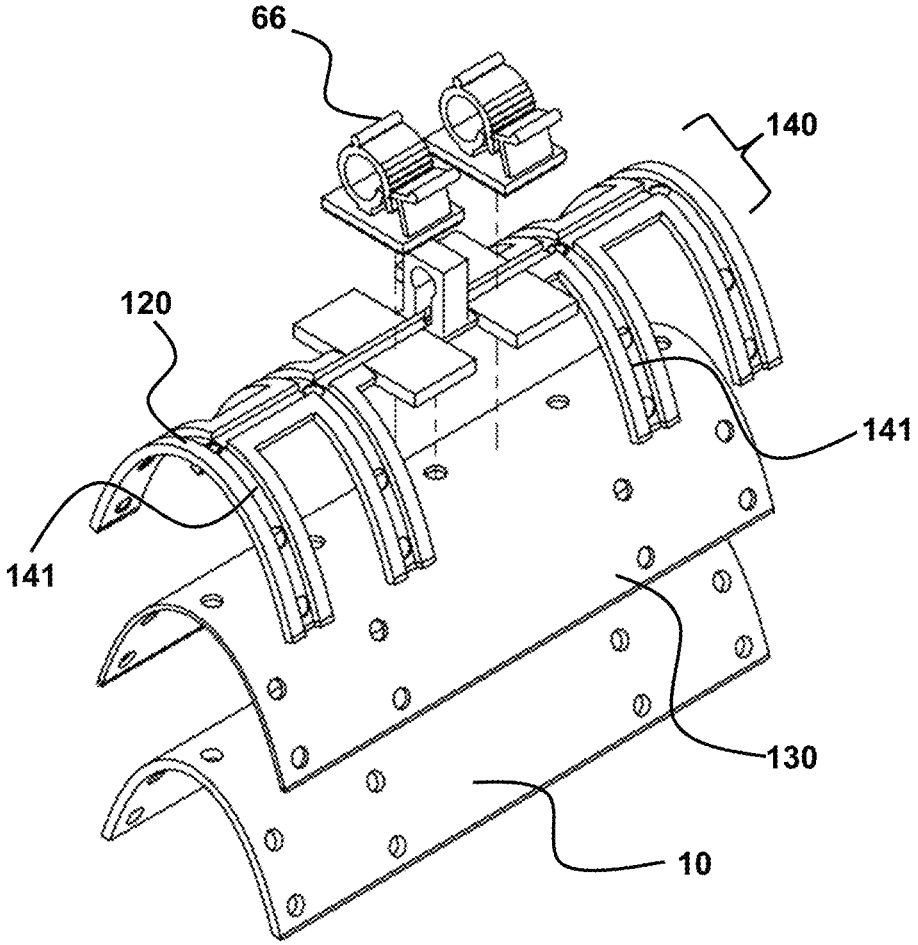
FIG. 12B is an exploded view to better illustrate a SMART tamp placed between the former of the explosive shell and the firing train guide to prevent shock coupling with the main charge through the material and premature initiation of the main charge at an undesirable location. For clarity, explosives are not shown.

Another technique to prevent undesirable initiation due to shock coupling is shown in FIGS. 12A-12B in which a SMART tamp layer 130 is placed between the explosives former 10 and the firing train guide 120. No explosives are shown in FIG. 12A-12B to aid the reader in focusing on the structural elements. FIG. 12B is an exploded view and illustrates the guide grooves 141 which position the sheet explosive strips (not shown). The sheet explosives strips may be positioned in an initiation zone 140 corresponding to a longitudinal axis at a curvature apex. As illustrated in FIG. 11, the initiation zone 140 is near the detonator.

Figure 13A:
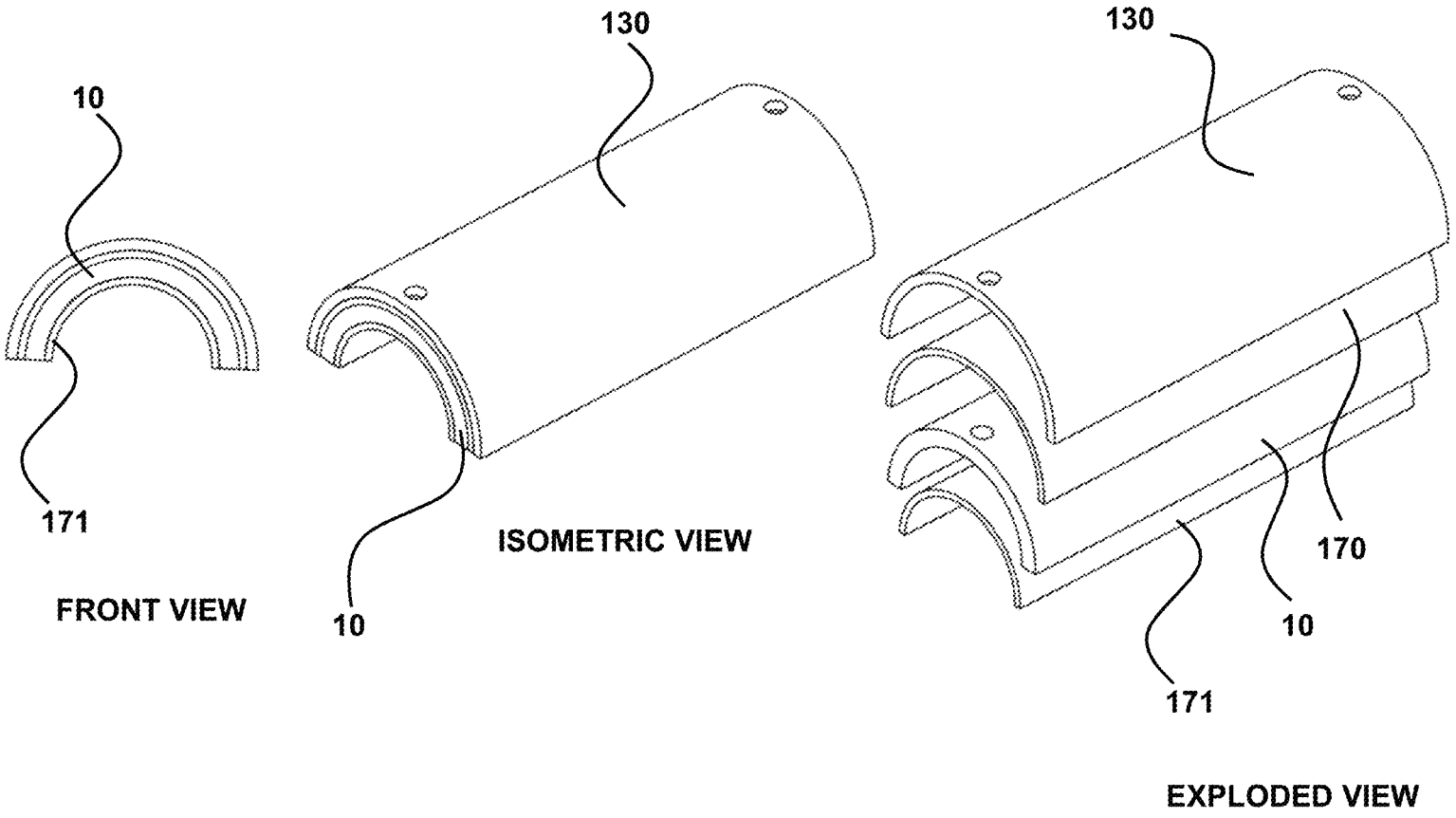
FIG. 13A illustrates a steel or metal explosive former sandwiched between two layers of sheet explosives. The outer layer of explosives generates forces that oppose the inner layer of explosives which has the primary function of imploding the fluid.
Figure 13B:
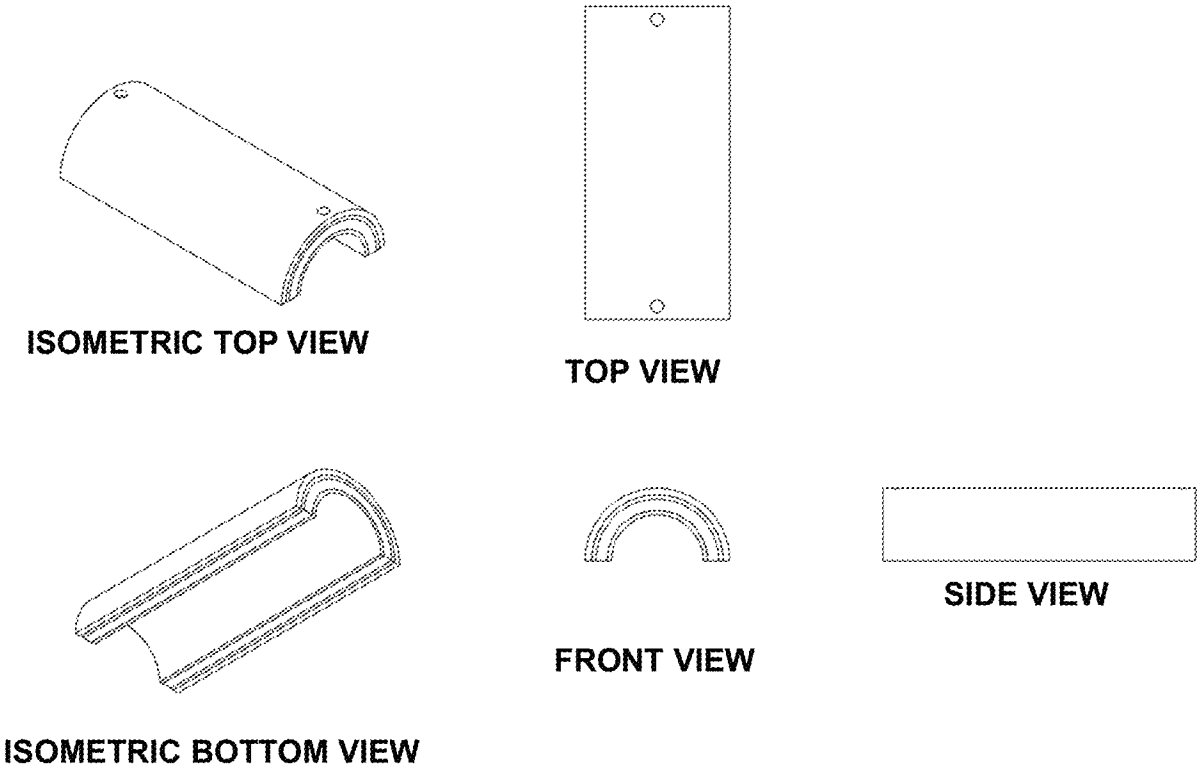
FIG. 13B is the assembled configuration with different views.

The explosives shell 10 contributes to tamping. No other mass focusing charge uses the explosives forming shell in this way. A common property that improves tamping is material density. PVC, for example, is 1.35 times denser than water; steel and copper are approximately 8 and 9 times denser than water, respectively. Steel and other metals, however, present a fragmentation hazard when they are used in the explosives shell above the water line or on dry land. This problem is addressed by explosively force balancing the reaction force of the main charge to cancel the acceleration and expansion of the metal shell. An identical or slightly higher amount of sheet explosives is wrapped on the opposite side of the explosives former (FIG. 13A-FIG. 13B). No distal body is shown in FIG. 13A-13B. The explosives forming shell 10 is sandwiched between the layers 170 and 171 of sheet explosives. The shock properties are greatly enhanced as there is a positive shock reflection off the steel former. The second layer of explosives sends a forward moving shock through the steel that adds to the duration of loading on the water slug. The transmitted shock arrives at a layer of SMART acting as a SMART tamp 130 which attenuates it and delays the returning rarefaction wave formed at the SMART-air boundary. This further increases pressure and duration of loading on the fluid slug. FIG. 13B provides various views of the explosives shell with outer and inner shape conforming explosives and a SMART tamp.

Figure 14:
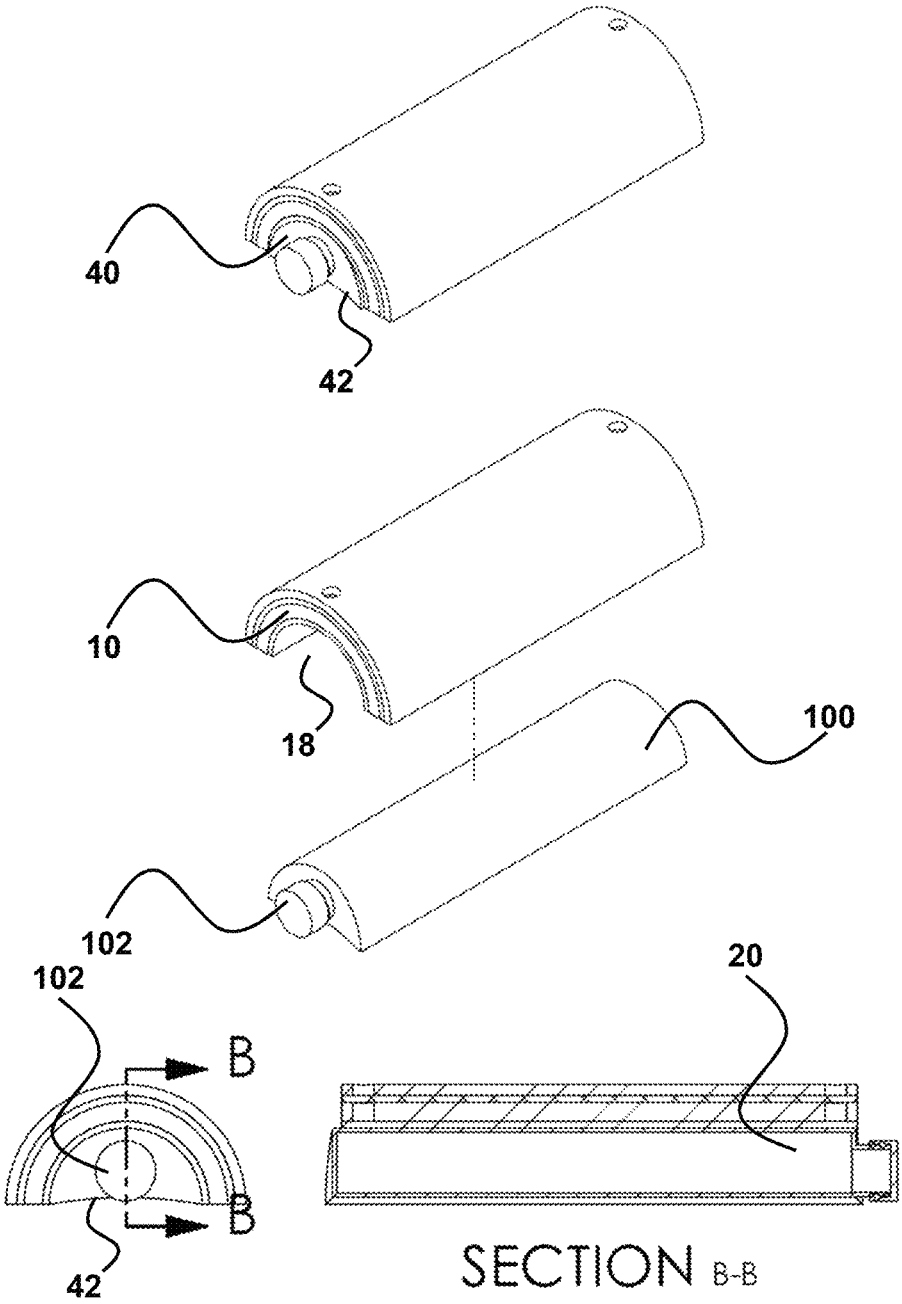
FIG. 14: For land-based operations, the multilayered explosive former design is compact. The only fluid required is the inner volume of fluid which fills the volume of a closed container having a surface that conforms to the explosive forming shell.

For land-based operations, the design shown in FIG. 14 is more efficient than the conventional submersion of the explosives in a fluid filled container or placing the explosives between two fluid filled containers to form the tamp and slug. In this example, the inner volume of fluid is contained within a distal body 40 having a distal surface 42 that is curved. The distal body 40 corresponds to a sealable container 100 having a seal 102 that occupies inner volume 18. The volume of the charge is vastly reduced and due to its efficiency, less tamp material is required; there is a reduction in total weight. The mass focusing disrupter is compact making it suitable for dismounted and tactical operations. This embodiment may be used in SWAT explosive breaching operations to breach doors or walls, or to create gun or viewing ports. Over pressure is reduced by the SMART material which also makes it applicable for operations inside of dwellings and interior structures. Curvature can be added to the distal surface of the inner fluid container to further improve jetting properties of the disrupter.

Figure 15:
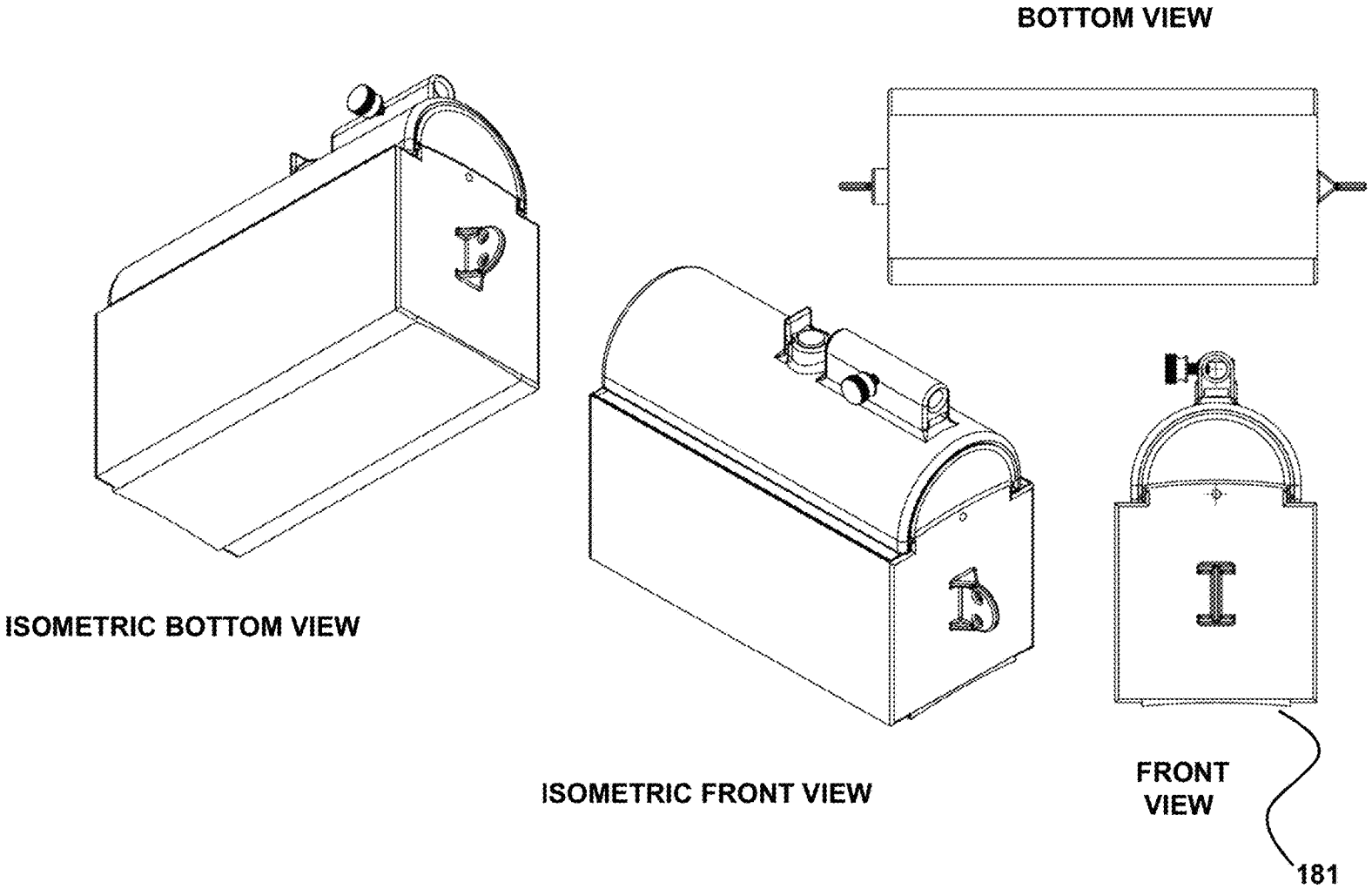
FIG. 15 is an embodiment of a mass focusing shaped charge with a SMART box configured to contain a SMART material, that also illustrates the distal surface can be curved for more intimate contact to a target surface.

FIG. 15 is an additional embodiment of a mass focusing shaped charge, including a SMART box with detonator lead strain relief anchor, tow line attachment point and a curved distal surface. The curved distal surface 181 allows for more intimate contact to a target surface. In this manner, the distal surface may of the shaped charge may be shaped to correspond to a target surface to facilitate intimate contact that minimizes water between the shaped charge distal surface and the target.

In other embodiments, including as exemplified in FIGS. 16-19, the mass focusing shaped charge is configured to provide disablement capability through, at least in part, the ground. This has applications related to a target that is at least partially or completely buried ordnance, including unexploded ordnance from previous conflicts. For example, any of the mass focusing shaped charges described herein may be connected to a stand to reliably position the direction of a resultant explosively-driven fluid used to disable the target.

Figure 16:
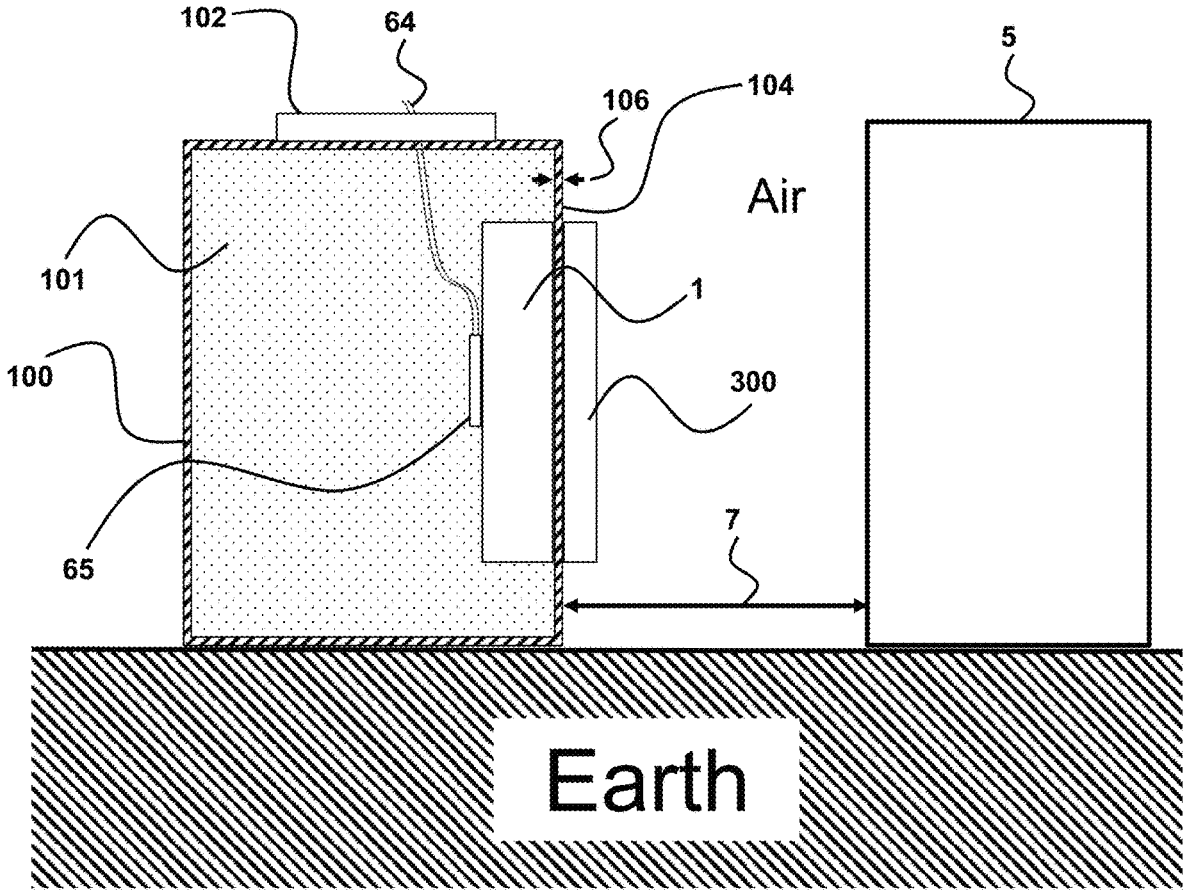
FIG. 16 illustrates a SMART material operably connected to an outer distal surface of the container. The SMART material is in an opposable configuration to the shaped charge (HPD) with the HPD operably connected to the inside face of the container so that the container distal surface is effectively sandwiched between the HPD and the SMART material.

FIG. 16 illustrates mass focusing shaped charge 1 in a container 100, with the container set a standoff distance 7 from a target 5. A smart material 300 is connected to an outer facing surface of container distal surface 104. The shaped charge 1 is connected to an inner facing surface of container distal surface 104, wherein the inner and outer facing surfaces are separated by the container distal wall thickness 106. In this manner, the SMART material 300 can be characterized in an opposable configuration relative to the shaped charge 1. The container 100 has a fluid-filled container volume 101. A detonator 65 with detonator lead wires provide controlled detonation of shape charge 1, with the SMART material 300 configured to ensure good fluid jet characteristics as fluid jet is explosively driven from the container volume toward the target. In this manner, the shaped charge described herein may be used to traverse a stand-off distance through air. The container 100 may have a container seal 102 corresponding to a lid for positioning of shaped charge 1 and/or filling of container volume 101 with liquid, such as water. Use of a SMART material component on the front distal surface provides the benefit of helping to facilitate maintenance of fluid jet characteristics as the fluid jet travels toward target 7, including by avoiding degrading effects otherwise caused by rarefaction waves after explosive detonation. Use of a SMART material that is buoyant (e.g., lower density relative to the liquid in the container) is facilitated by mounting the SMART material to an outer surface of the container distal surface.

Figure 17:
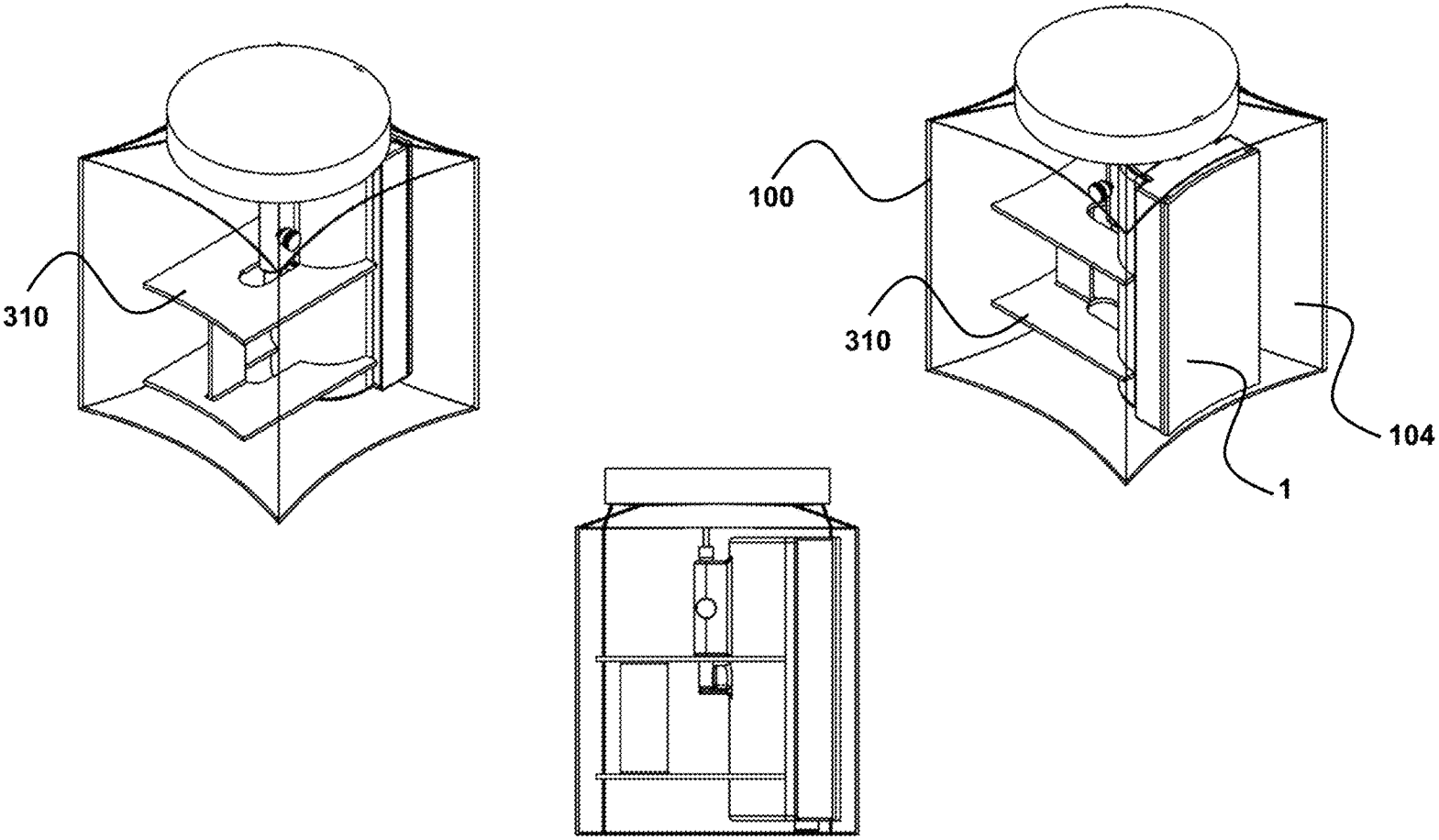
FIG. 17 illustrates use of a structural support to reliably position the shaped charge (HPD) inside a container.

FIG. 17 illustrates use of a structural support 310 to reliably positioned the shaped charge 1 in a container 100 for three different views. In this example, the structural support is in contact with a proximal surface of the container 100 and the half pipe disrupter (HPD) 1. It braces the HPD 1 up against the container distal surface 104 (see, e.g., FIG. 16), restricting unwanted shaped charge (HPD) movement and reliably fixing into a desired position inside the fluid filled container 100. In this example, the container distal surface 104 has a curved geometry. The invention is, of course, compatible with other structural supports beyond the brace of FIG. 17. For example, an adhesive, such as glue, can be used to bond the HPD 1 to the distal surface 104 of the container 100, thereby fixing shaped charge HPD 1 into position. In this configuration, the explosives forming shell can be separate from the SMART box which could be glued inside the container. The explosives forming shell can then be loaded with sheet explosives and then seated to the SMART box. The structural support 310 may be made of a material that matches a property of the fluid in the container. For example, for a water-filled container, the structural support may be formed from PVC having a higher density than water or of another material that matches the density of water.

Figure 18A:
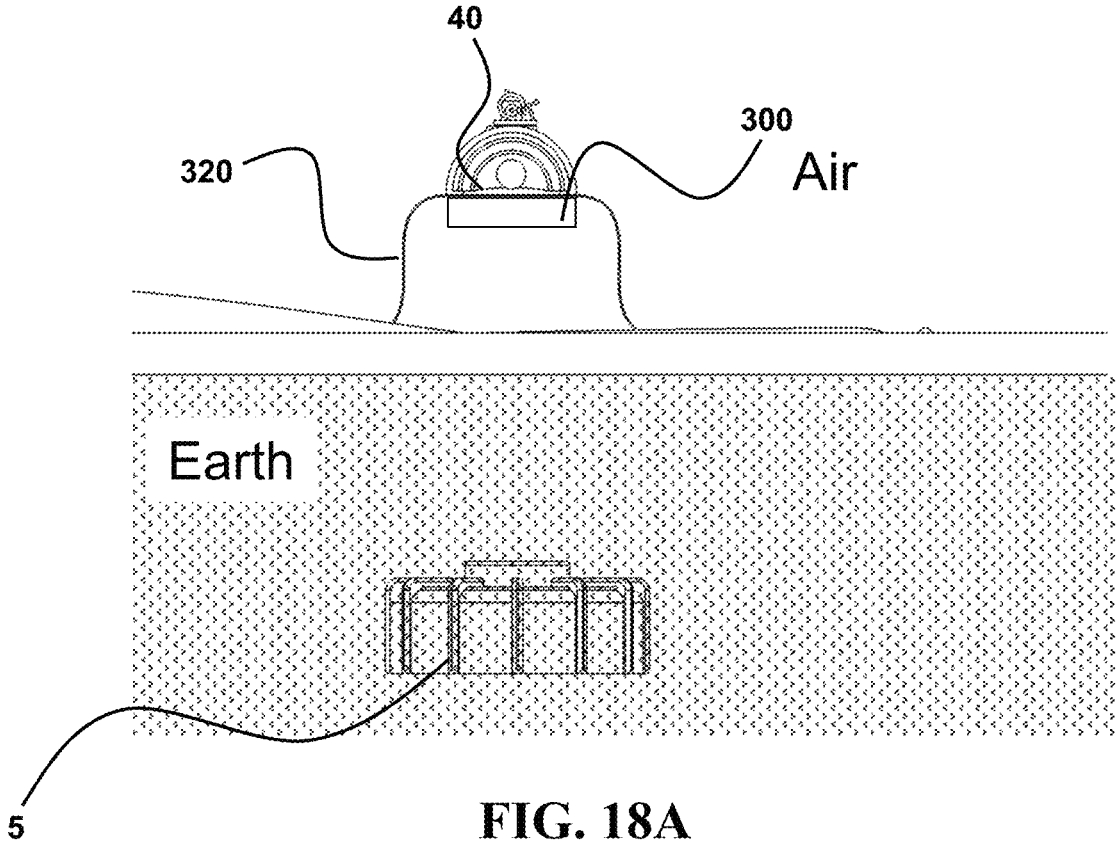
FIGS. 18A (front view) and 18B (side view) show a shaped charge used to disable a buried target, such as a mine by use with a stand that supports and positions the shaped charge.
Figure 18B:
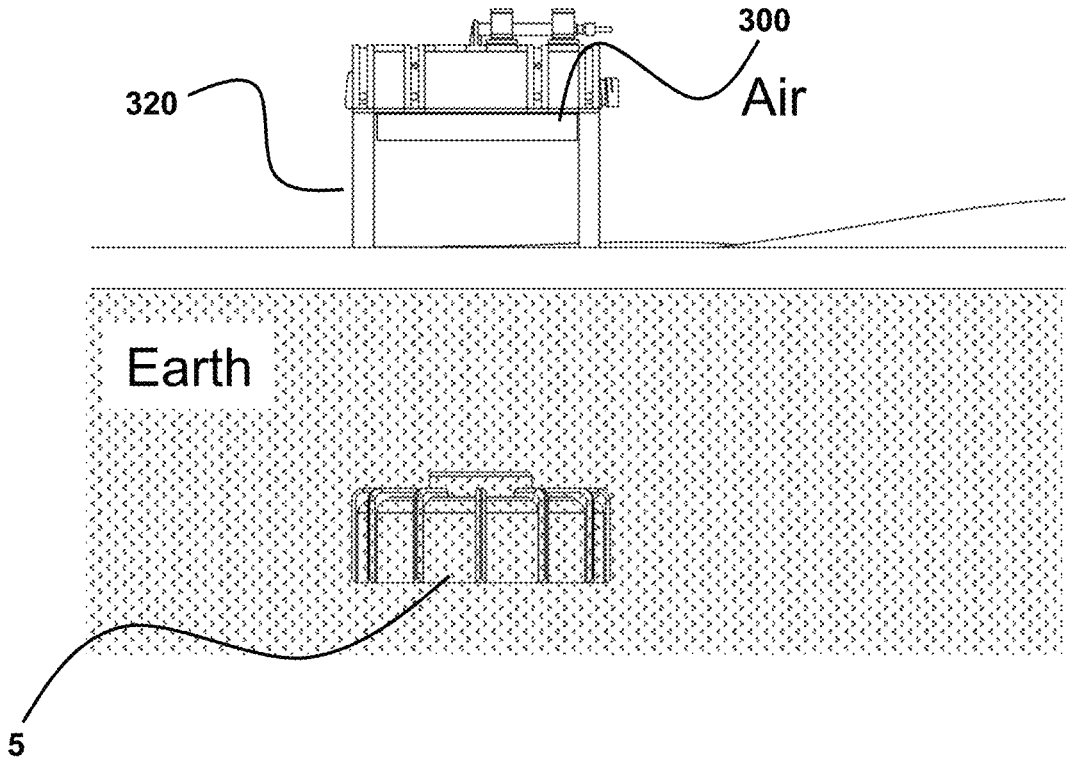

FIGS. 18A-18B illustrate an embodiment where the fluid jet can penetrate the Earth (e.g., soil or sand) and disable a buried target 5, such as a mine. A flexible stand 320 positions the disrupter leveling it on uneven ground and setting a standoff distance. The stand can be made from plastic, or metal such as steel or aluminum. A non-magnetic material can be used if there is concern regarding use of a metal detection sensor in the mine.

Figure 19A:
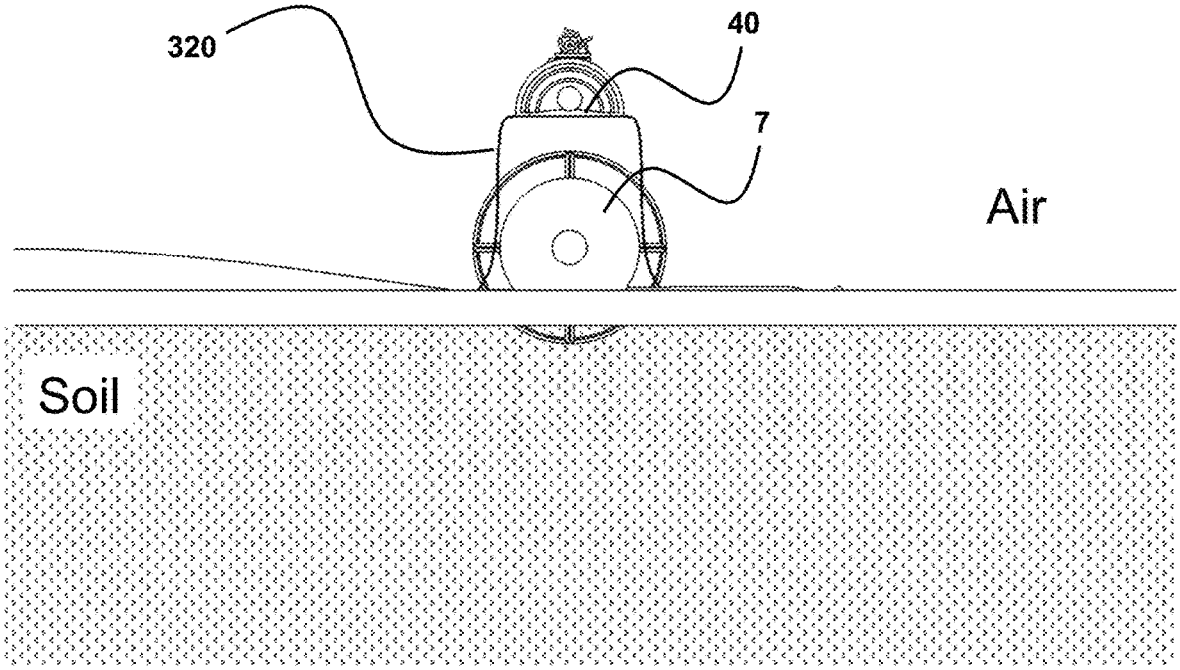
FIGS. 19A (front view) and 19B (side view) illustrates use of a stand for disrupting a target that is partially buried.
Figure 19B:
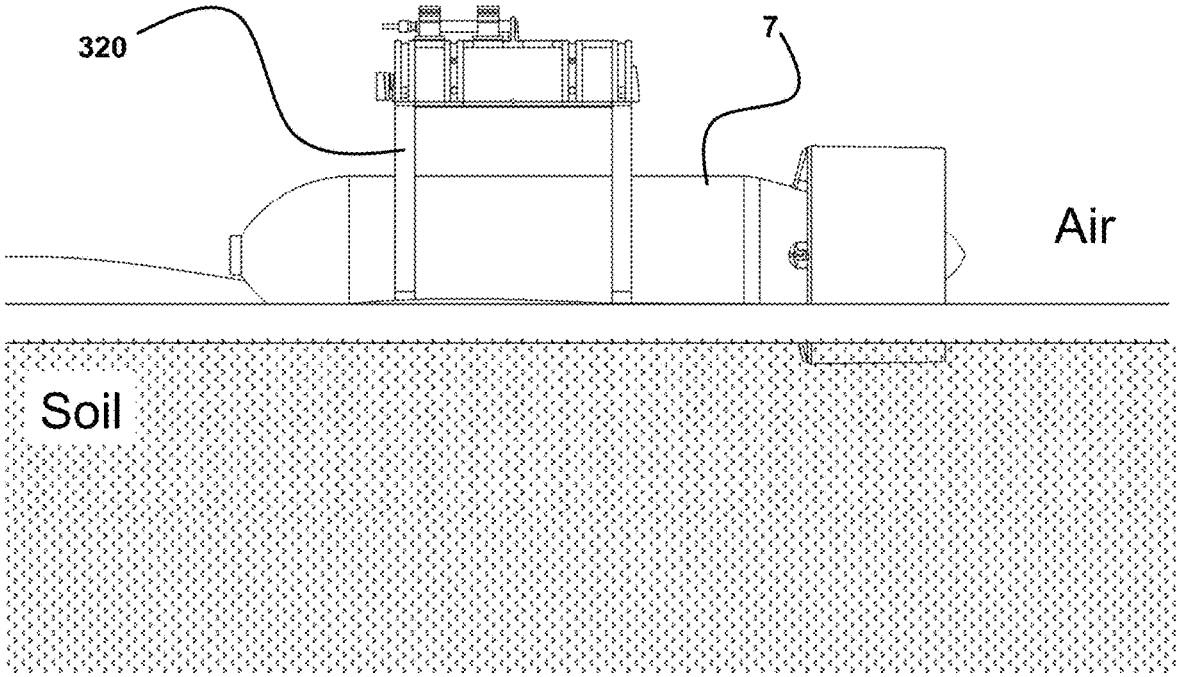

FIGS. 19A-19B, are similar to FIGS. 18A-18B, but with a target 5 that is a partially buried aerial bomb. Using a flexible stand 320, the HPD can be positioned over an explosive remnant of war, such as an aerial bomb. The stand keeps the HPD from making direct contact with the bomb and can level it and position the HPD at a specific location so that the fluid jet ruptures and/or deforms the bomb casing, resulting in safe disruption without uncontrolled target explosion.

Figure 20:
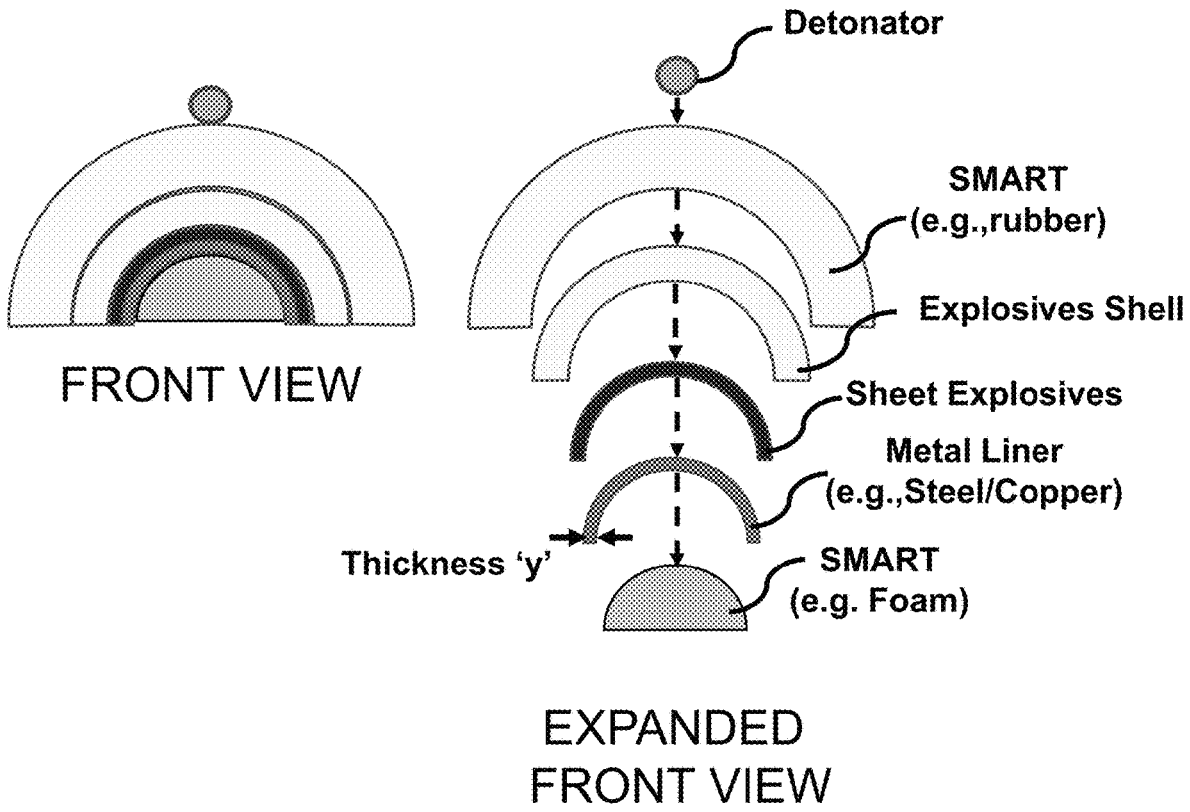
FIG. 20 is a sectioned view of a more classical embodiment of a mass focusing shaped charge configured to form a linear metal jet from a metal liner, such as copper or steel.
Figure 21:
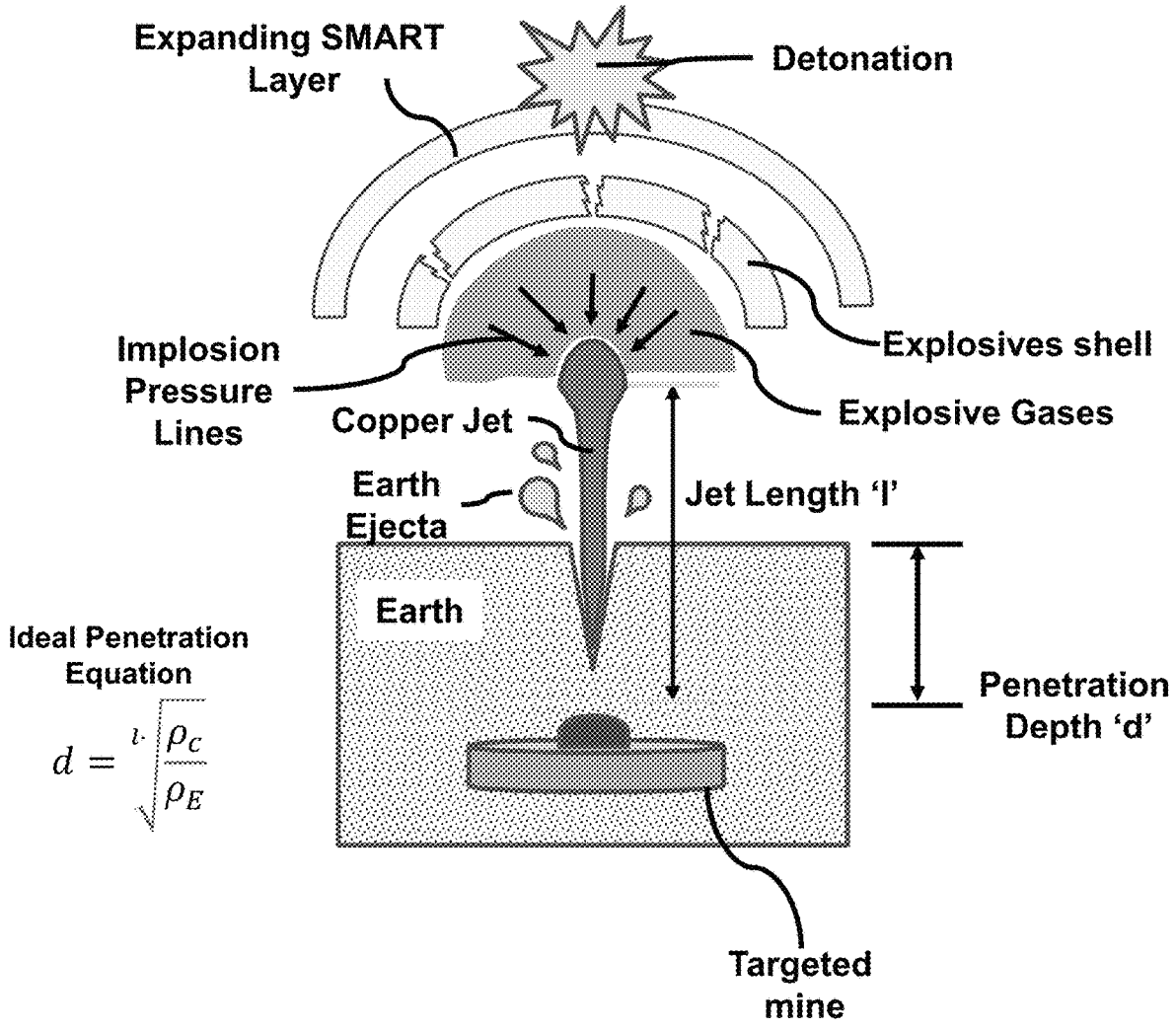
FIG. 21 illustrates the mass focusing shaped charge of FIG. 20 during a jet formation event. The jet is formed from a mass of the metal liner and is illustrated traversing an air gap (stand-off distance between the shaped charge and the ground) and an Earth gap (penetrating depth "d") toward a target that is a buried mine.

The examples provided in FIGS. 18A-19B may also use a metal liner, such as copper or steel having a thickness between about 0.0625 inches-0.125" that form a portion of the distal body 40 (along with SMART material 300). In this aspect, the HPD has characteristics similar to a classical shaped charge, such as no intervening fluid volume 20 as illustrated in FIG. 14. This HPD mass focusing shaped charge embodiment that effectively jets a blade of plastically formed metal is further illustrated in FIGS. 20-21. In this embodiment, the HPD is configured so that upon explosive detonation by detonator a linear metal jet is formed. Typical metals useful in the invention include, but are not limited to, copper or steel. The jet profile is a blade of plastically formed metal. The implosion pressure is high and exceeds the Huguenot Elastic Limit (HEL) of the metal liner of thickness 'y'. Above the HEL a metal will behave hydrodynamically. The metal is crushed and flows outward at high velocities. Because this is a more classical shaped charge, the jet penetration is defined by the ideal penetration equation. Using the classical shaped charge embodiment, the HPD jet can cut through steel, armor, and earth (soil or sand). This embodiment preferably has two SMART components, such as a first SMART material supported by the outer surface of the explosives shell (labeled in FIG. 20 as a rubber), and a second SMART material that is supported by the metal liner (labeled in FIG. 20 as a foam). The second SMART material may occupy the inner volume and is selected to provide desired jet characteristics for the metal of the metal liner that jets toward target depending on the application (e.g., stand-off distances, target type, metal composition, explosives composition and configuration, operating conditions etc.).

I claim:

1. A mass focusing shaped charge to disrupt a target comprising:

an explosives shell having:

an explosives shell surface having an inside surface and an outside surface;

an explosives shell sectioned profile that is at least partially curved;

one or more symmetry planes;

an inner volume defined by the explosives shell inside surface configured to contain an inner volume of fluid;

a distal opening;

a distal body connected to the explosives shell distal opening to close the inner volume and contain the inner volume of fluid, wherein the distal body comprises a SMART material that is positioned between the inner volume of fluid and the target;

a fluid body, wherein the explosives shell is immersed in the fluid body;

a conformable layer of explosives that conforms to at least a portion of a surface of the explosives shell, the conformable layer of explosives configured for explosive initiation by a detonator;

wherein upon explosive initiation the inner volume of fluid is configured to implode and form a fluid jet that is forced in a direction through the distal body toward the target.

2. The mass focusing shaped charge of claim 1, wherein the fluid body forms the inner volume of fluid.

3. The mass focusing shaped charge of claim 1, wherein the inner volume of fluid is formed from a liquid that is different than the fluid body.

4. The mass focusing shaped charge of claim 1, wherein the at least partially curved explosives shell section profile is defined by a geometric equation that is selected from the group consisting of:

a semicircle;

a parabola;

two equal length lines that end at an intersecting apex;

a line; and any combination thereof.

5. The mass focusing shaped charge of claim 1 wherein the SMART material is selected from the group consisting of: rigid polyurethane, a vinyl closed cell foam, a polyvinylchloride foam, and a structural foam.

6. The mass focusing shaped charge of claim 1, where the inner volume of fluid has a fluid volume corresponding to a closed surface formed between the explosives shell and the SMART material.

7. The mass focusing shaped charge of claim 1, wherein the SMART material is formed into:

a cuboid geometry; or has a proximal surface with a profile corresponding to an arc, paraboloid, or pyramidal geometry.

8. The mass focusing shaped charge of claim 1, wherein the explosives shell is formed of a material that is flexible to provide an adjustable curvature by a changeable radius of curvature.

9. The mass focusing shaped charge of claim 1, wherein the SMART material comprises a plurality of SMART layers, including a distal-most layer that is a jet clipper and at least one layer that is not a jet clipper.

10. The mass focusing shaped charge of claim 1, further comprising a coupler connected to an outer surface of the explosives shell to connect to another mass focusing shaped charge in an end-to-end configuration.

11. The mass focusing shaped charge of claim 1, further comprising a container having a container volume to contain the mass focusing shaped charge and the fluid body contained by the container surrounds the explosives shell, wherein the container has a seal to contain the fluid body in the container volume, wherein the seal is optionally a threadable lid or a snap-on lid.

12. The mass focusing shaped charge of claim 1, further comprising a firing train comprising a single detonator operably connected to the conformable layer of explosives, wherein the firing train is configured to provide a single point or multi-point explosive initiation of the conformable layer of explosives comprising one or more sheet explosives strips.

13. The mass focusing shaped charge of claim 12, having a single point of initiation in an initiation zone that is on a longitudinal axis at a curvature apex at one of the following locations:

at a charge center of the sheet explosives strip; or adjacent to a boundary edge of the sheet explosives strip.

14. The mass focusing shaped charge of claim 1, further comprising a sealable container that is operably connected to the explosives shell, the sealable container having a surface shape that aligns with the conformable layer of explosives; wherein the sealable container is filled with the inner volume of fluid that is positioned in the explosives shell inner volume.

15. The mass focusing shaped charge of claim 14, wherein the explosives shell is formed of a material comprising plastic, steel, copper, aluminum, or brass, wherein the conformable layer of explosives comprises:

an outer explosives layer; and an inner explosives layer; that together counteract an explosive ejection of the shell.

16. The mass focusing shaped charge of claim 15, further comprising a SMART tamp that covers the outer explosives layer, wherein the SMART tamp is formed from a natural or synthetic rubber.

17. The mass focusing shaped charge of claim 1 that is geometrically and/or translationally scaled proportionally relative to a height, a depth along a jet trajectory, or a barrier thickness of the target for controllable adjustment of at least one of the following target disruption parameters:

a target barrier perforation;

a target depth of penetration;

an impact pressure; or a jet velocity.

18. The mass focusing shaped charge of claim 1, wherein the target is a land-based target with air positioned between the mass focusing shaped charge and the target, wherein:

the distal body is formed from a portion of a container that surrounds and contains the explosives shell and fluid body;

the SMART material is positioned on an outer facing surface of the container and between the explosives shell and the target.

19. A method of disrupting a target, the method comprising the steps of:

providing a mass focusing shaped charge of claim 1;

aligning the mass focusing shaped charge with a target;

detonating the conformable layer of explosives to explosively drive the inner volume of fluid to the target in a fluid jet; thereby disrupting the target.

20. A mass focusing shaped charge for disrupting a target comprising:

an explosives shell having:

an explosives shell surface having an inside surface and an outside surface;

an explosives shell sectioned profile that is at least partially curved;

one or more symmetry planes;

an inner volume defined by the explosives shell inside surface;

a metal liner supported by the explosives shell inside surface;

a first SMART material supported by the explosives shell outside surface;

a conformable layer of explosives that conforms to at least a portion of the inside surface of the explosives shell, the conformable layer of explosives configured for explosive initiation by a detonator;

a metal liner supported by the conformable layer of explosives and positioned so that the conformable layer of explosives is sandwiched between the metal liner and the explosives shell;

a second SMART material supported by the metal liner, wherein the second SMART material occupies the inner volume of the explosives shell;

wherein upon explosive initiation the metal liner is crushed and flows as a jet having a blade geometry toward the target.

* * * * *